US008113248B2

(12) United States Patent
Lee et al.

(10) Patent No.: US 8,113,248 B2
(45) Date of Patent: Feb. 14, 2012

(54) DISPENSER RELATED TECHNOLOGY

(75) Inventors: Nam Gi Lee, Seoul (KR); Seong Jae Kim, Seoul (KR); Dong Jeong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 894 days.

(21) Appl. No.: 12/167,357

(22) Filed: Jul. 3, 2008

(65) Prior Publication Data

US 2009/0008403 A1 Jan. 8, 2009

Related U.S. Application Data

(60) Provisional application No. 60/950,377, filed on Jul. 18, 2007.

(30) Foreign Application Priority Data

Jul. 5, 2007 (KR) ..... 10-2007-0067635

(51) Int. Cl.
*F25D 23/12* (2006.01)
*B67D 3/00* (2006.01)

(52) U.S. Cl. ..... 141/358; 141/351; 141/2; 141/87; 222/146.6; 62/390; 62/66

(58) Field of Classification Search ..... 141/351, 141/354, 358, 360, 2, 87, 362; 62/66, 390, 62/161, 440, 126; 222/52, 146.6
See application file for complete search history.

(56) References Cited

U.S. PATENT DOCUMENTS

| | | | | |
|---|---|---|---|---|
| 4,209,999 | A * | 7/1980 | Falk et al. | 62/344 |
| 6,497,343 | B1 | 12/2002 | Teetsel | |
| 6,874,660 | B2 * | 4/2005 | Bertone | 222/129.4 |
| 7,287,555 | B2 * | 10/2007 | Heger et al. | 141/86 |
| 7,383,690 | B2 * | 6/2008 | Maglinger et al. | 62/137 |
| 7,757,732 | B2 * | 7/2010 | Voglewede et al. | 141/360 |
| 7,958,742 | B2 * | 6/2011 | Park et al. | 62/389 |
| 7,980,089 | B2 * | 7/2011 | Bowen et al. | 62/344 |
| 8,001,796 | B2 * | 8/2011 | Kim et al. | 62/66 |
| 8,006,502 | B2 * | 8/2011 | Kim et al. | 62/66 |
| 2006/0201194 | A1 | 9/2006 | Bowen et al. | |
| 2007/0289669 | A1 * | 12/2007 | An et al. | 141/362 |

FOREIGN PATENT DOCUMENTS

| | | |
|---|---|---|
| KR | 10-2004-0013820 | 2/2004 |
| KR | 10-2005-0028360 | 3/2005 |
| KR | 10-2005-0033296 | 4/2005 |
| KR | 10-2007-0066297 | 6/2007 |
| WO | 2007/063039 | 6/2007 |

OTHER PUBLICATIONS

International Search Report & Written Opinion issued in International Application No. PCT/KR2008/003945, mailed Jul. 1, 2009, 9 pages.

* cited by examiner

*Primary Examiner* — Timothy L Maust
*Assistant Examiner* — Timothy Kelly
(74) *Attorney, Agent, or Firm* — Fish & Richardson P.C.

(57) ABSTRACT

A food storing apparatus capable of dispensing a content stored in the apparatus is disclosed. The food storing apparatus includes a button tray composite device configured to function as a switch to control the dispensation of the content, but also configured to function as a tray for receiving a residual content discharged after the content dispensation.

26 Claims, 15 Drawing Sheets

【Fig. 1】
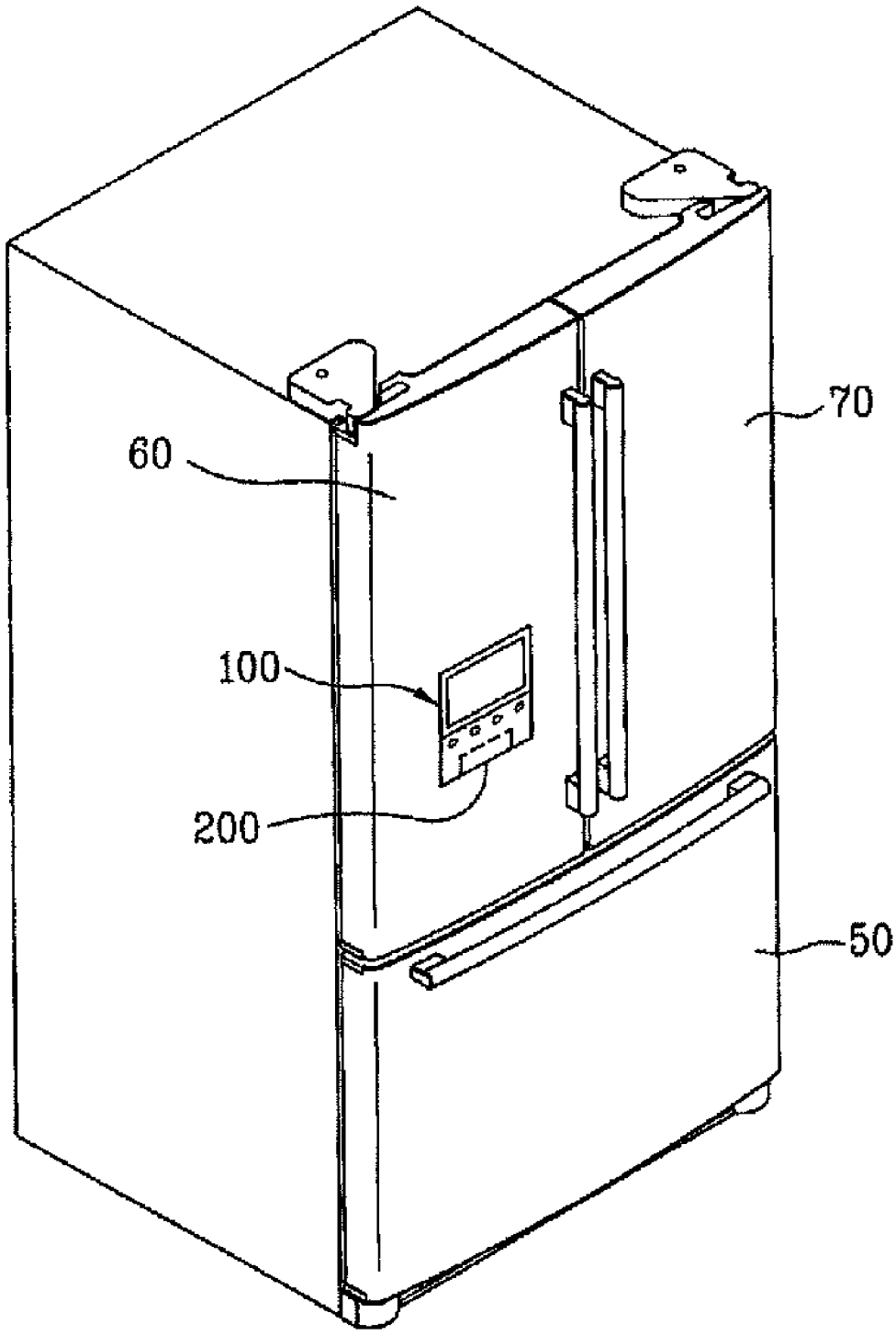

【Fig. 2】
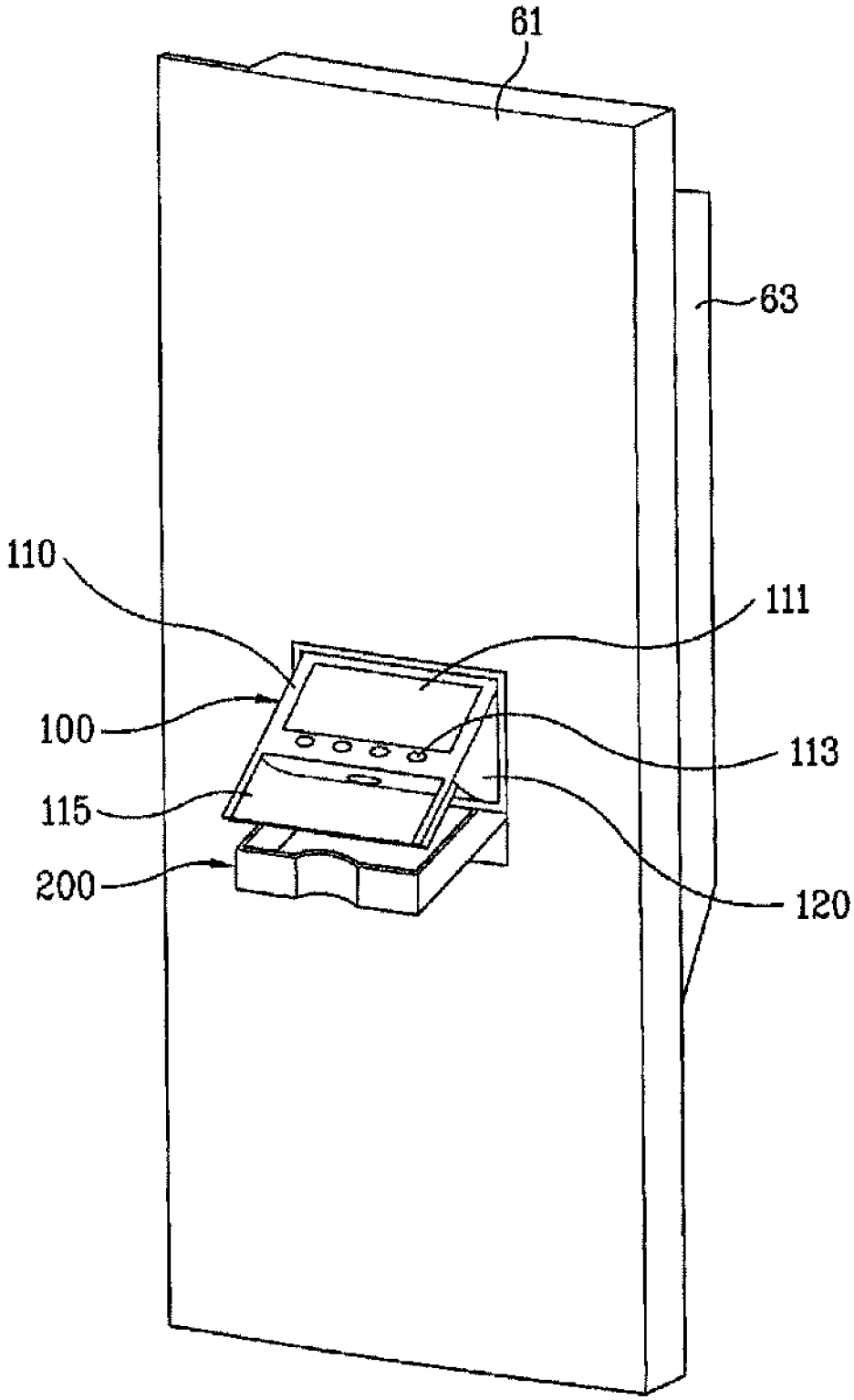

【Fig. 3a】
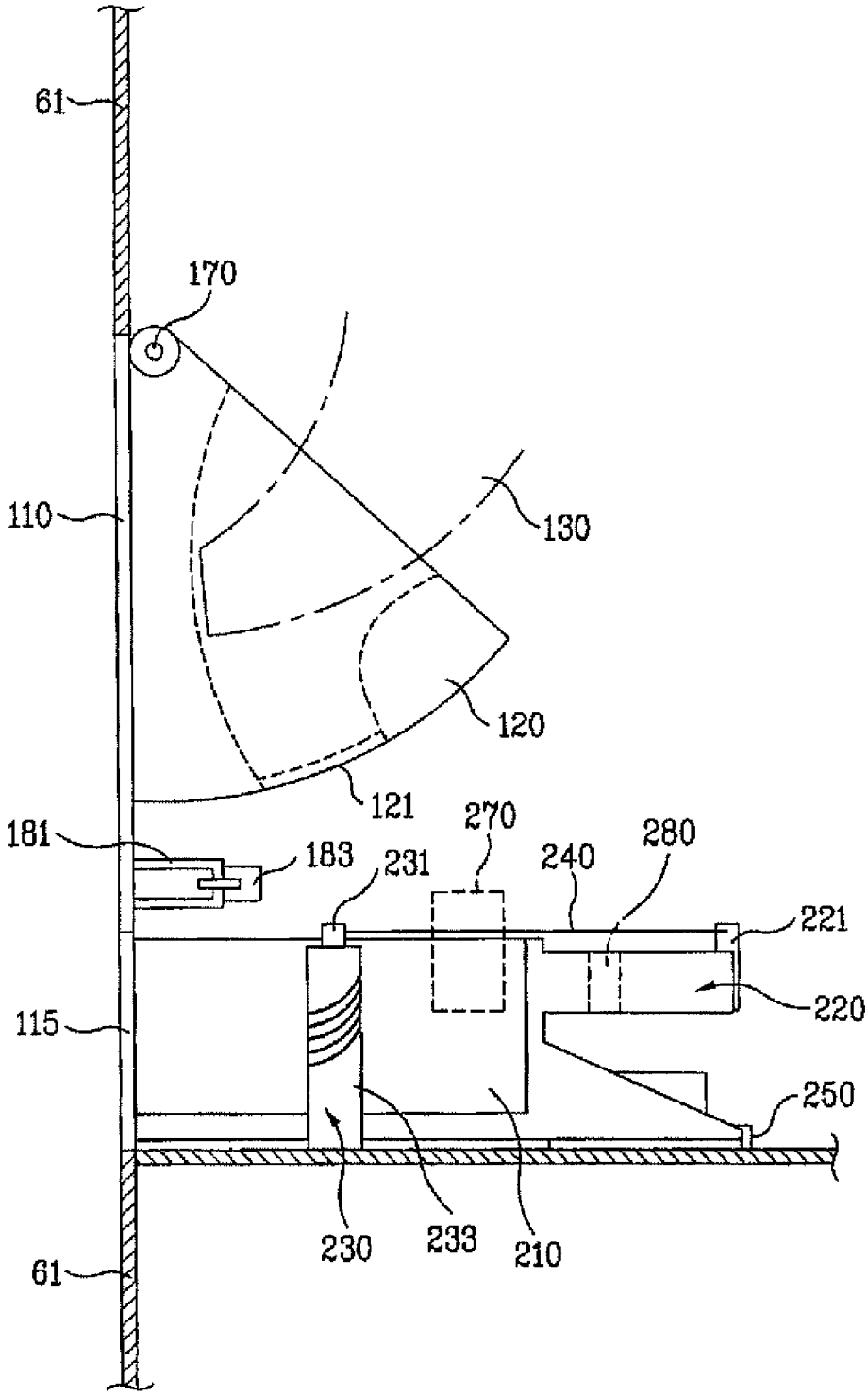

【Fig. 3b】
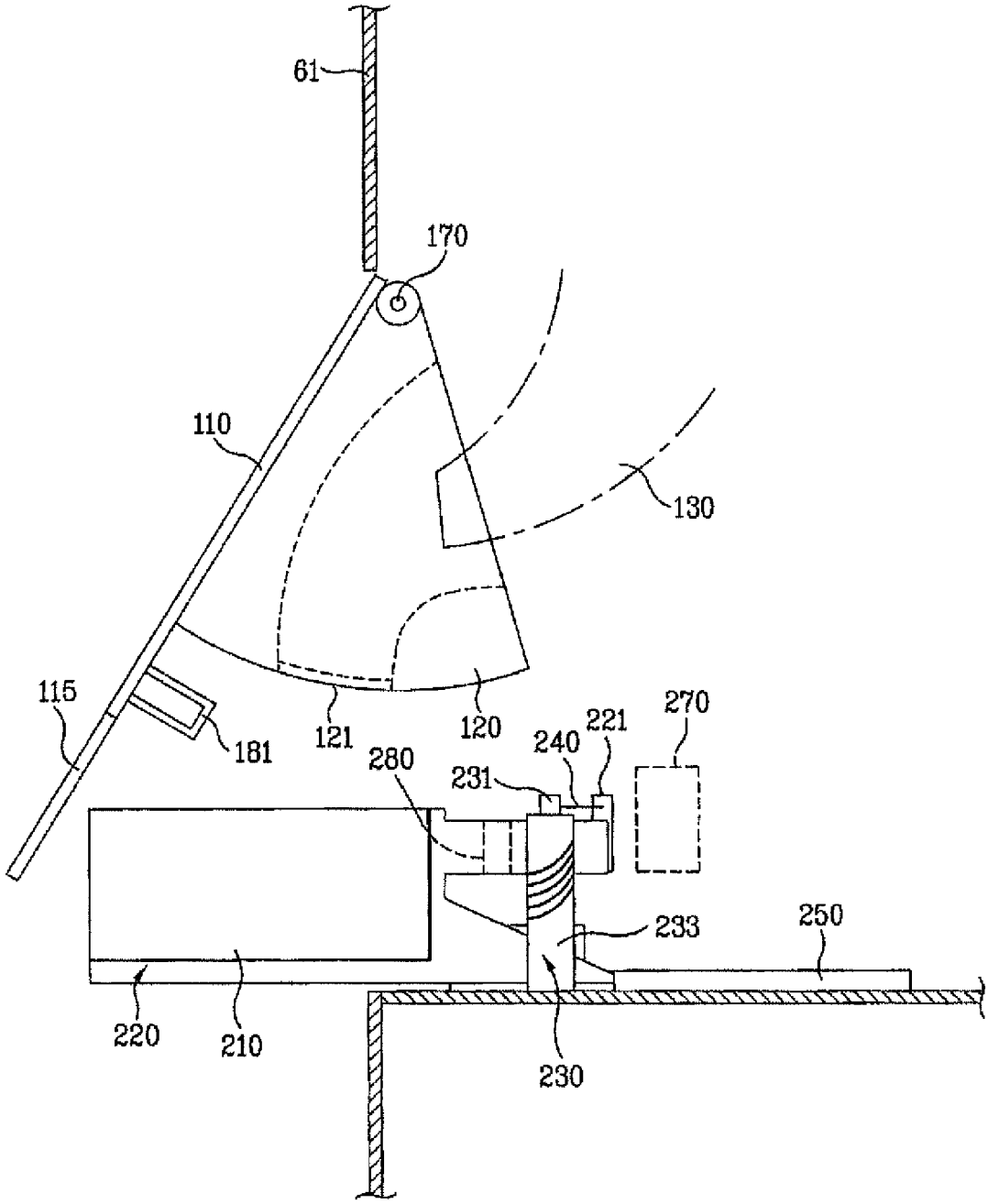

【Fig 4a】
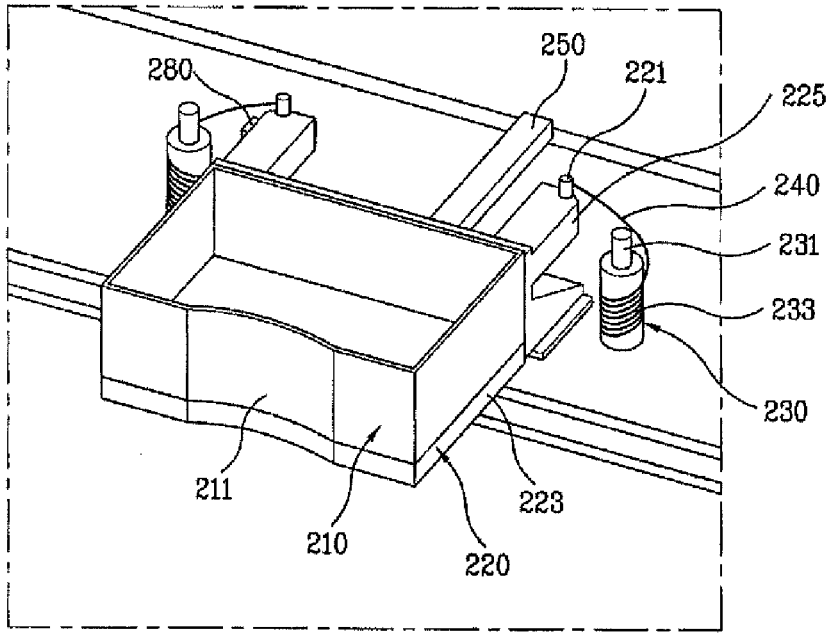
【Fig. 4b】
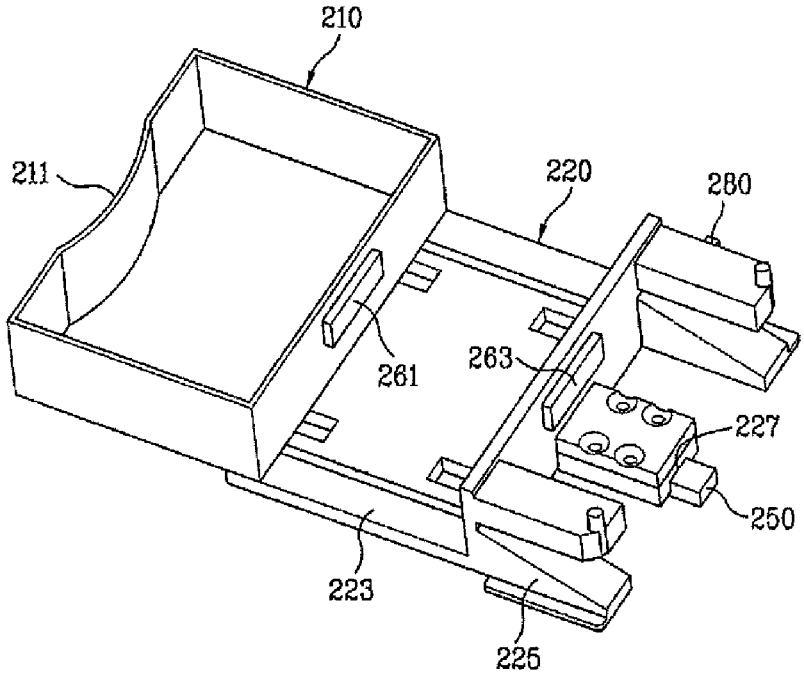

【Fig. 5a】
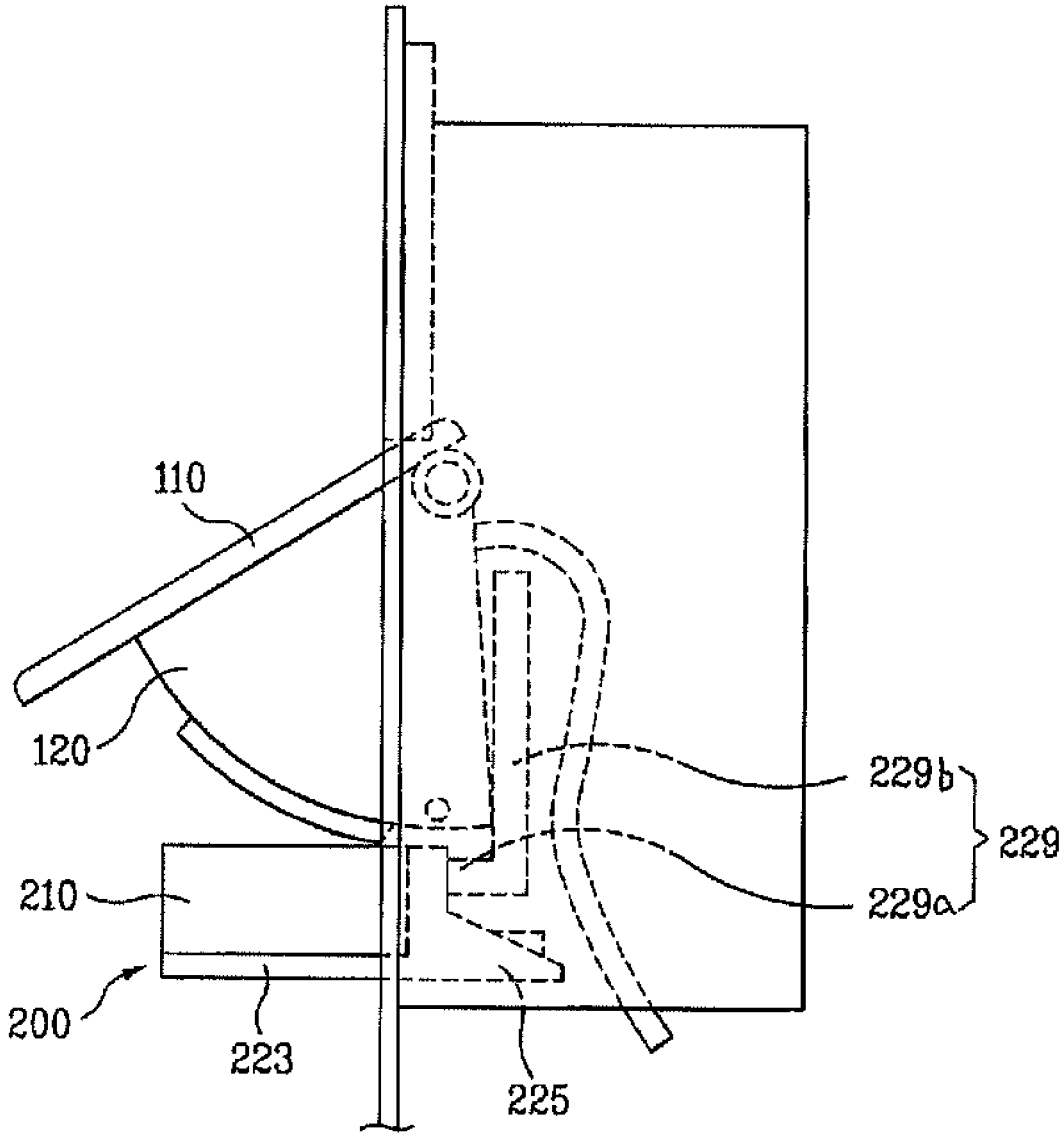

【Fig. 5b】
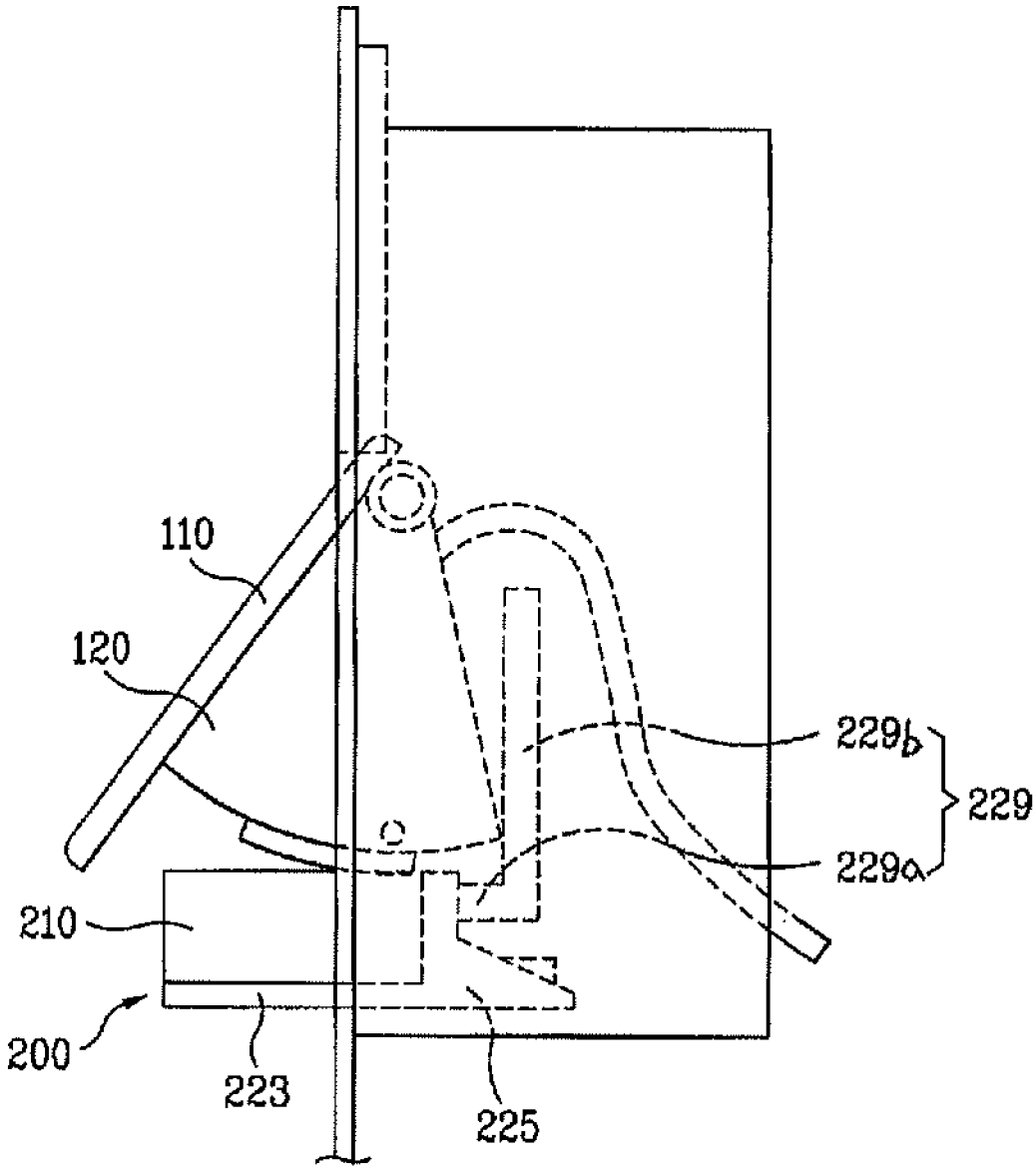

【Fig. 6a】
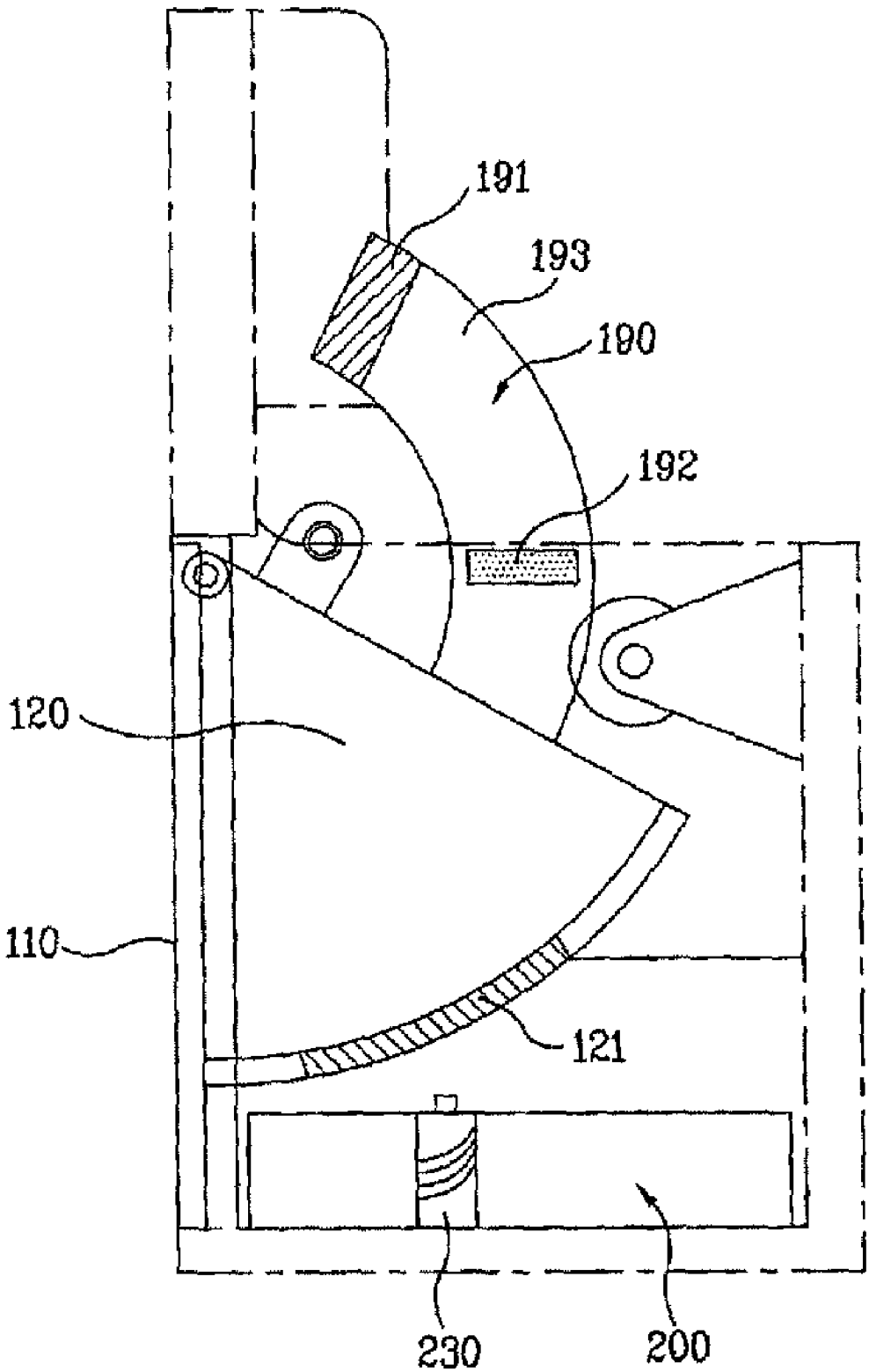

【Fig. 6b】
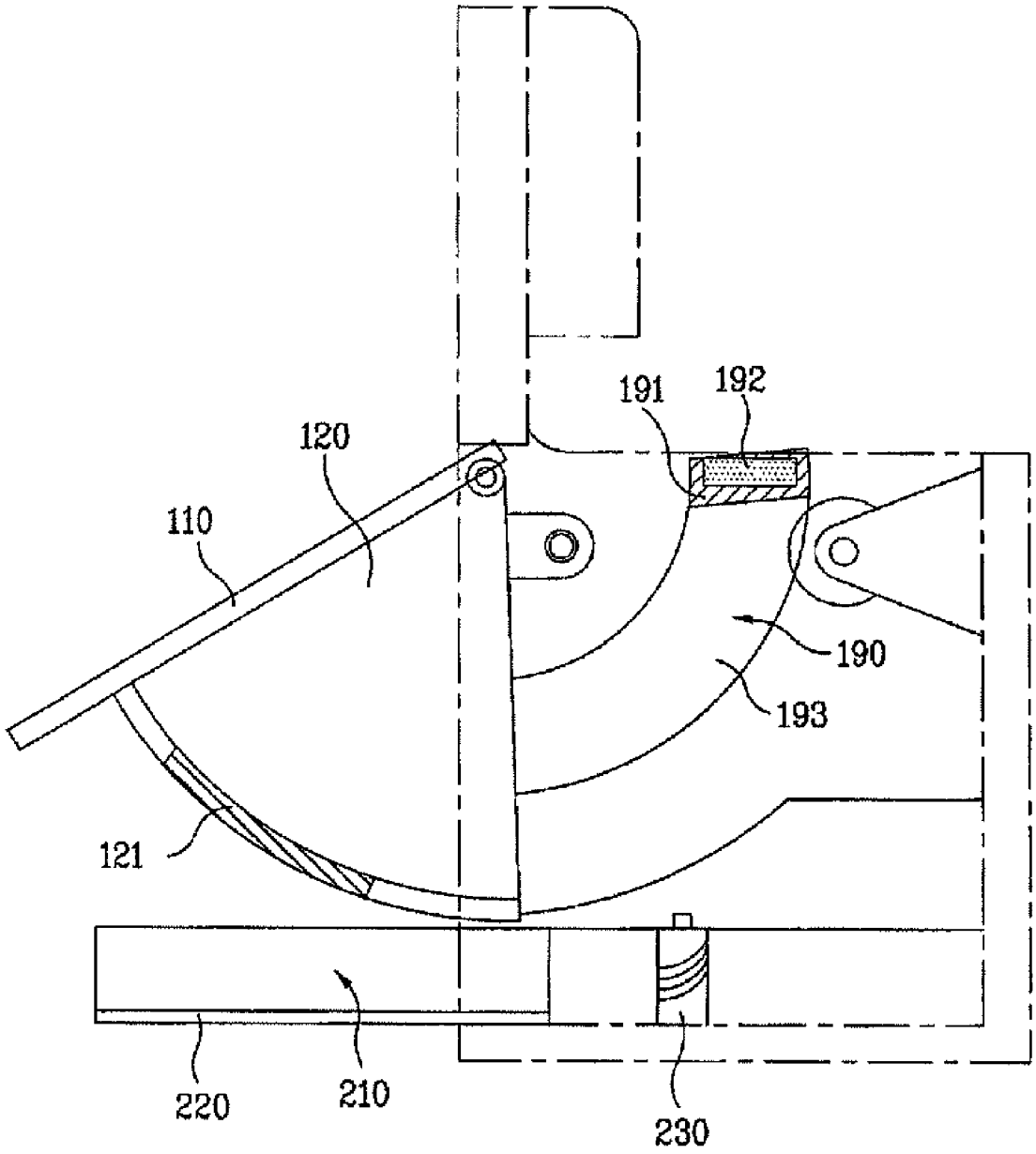

【Fig. 7】
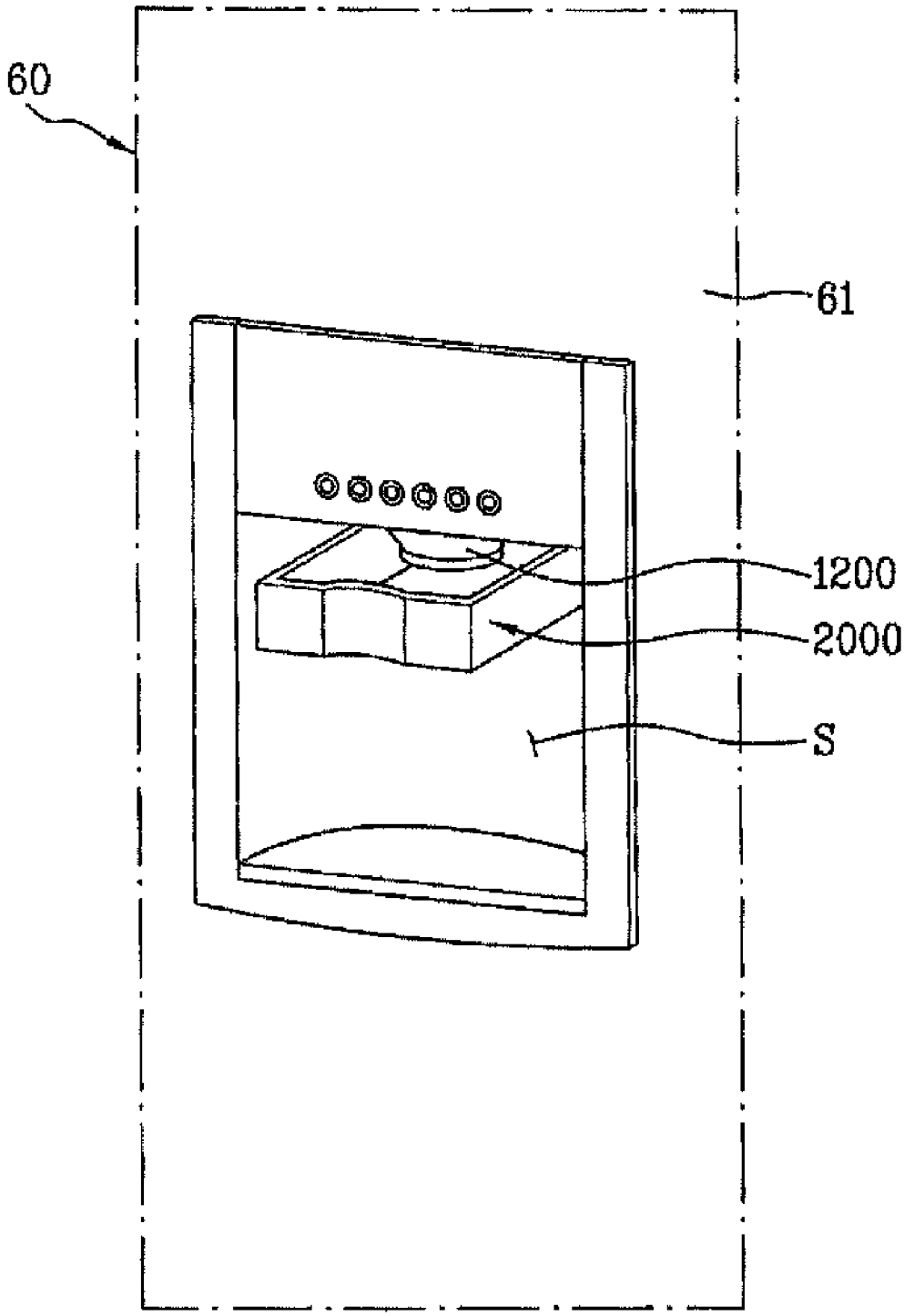

【Fig. 8a】
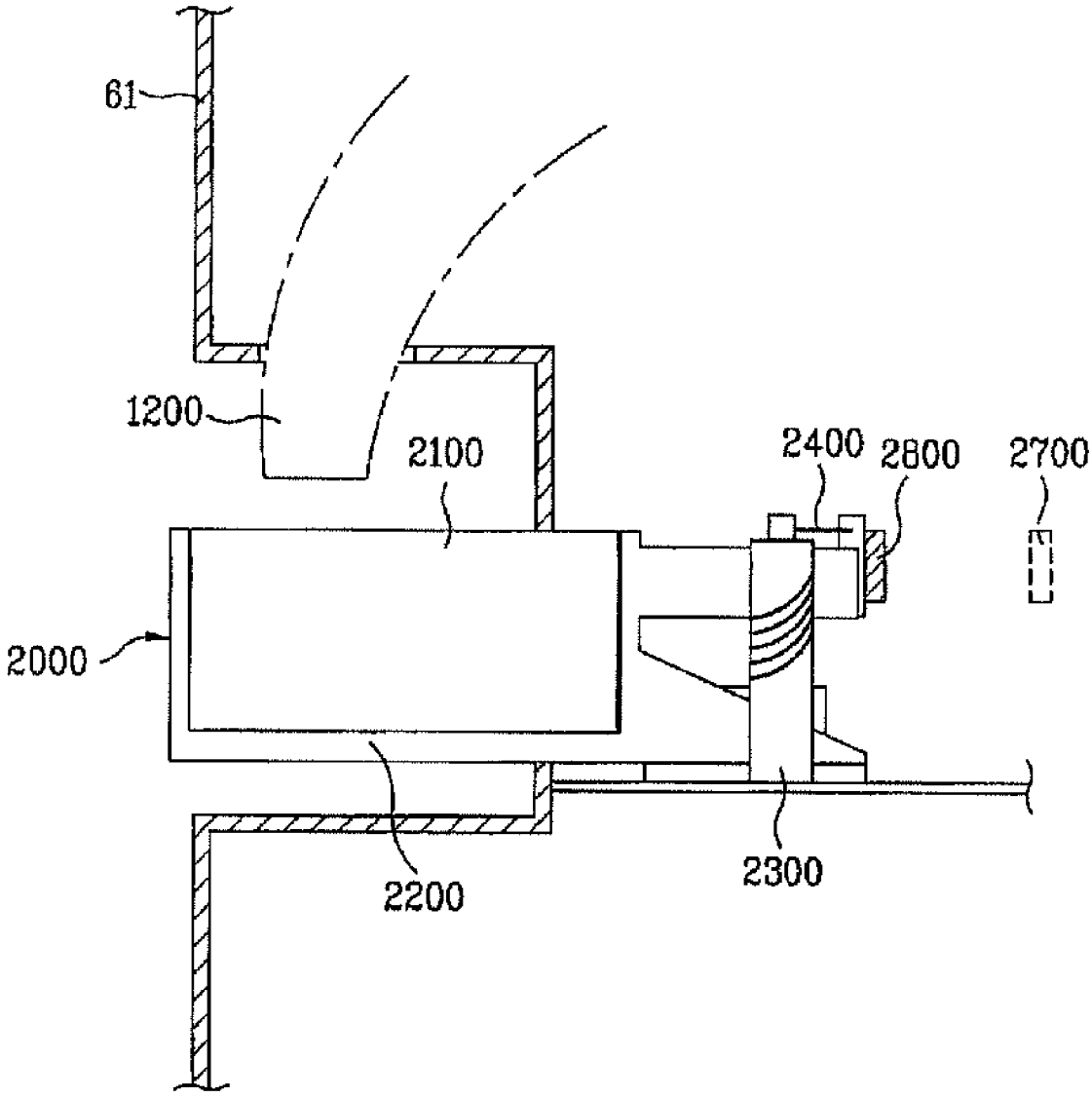

【Fig. 8b】
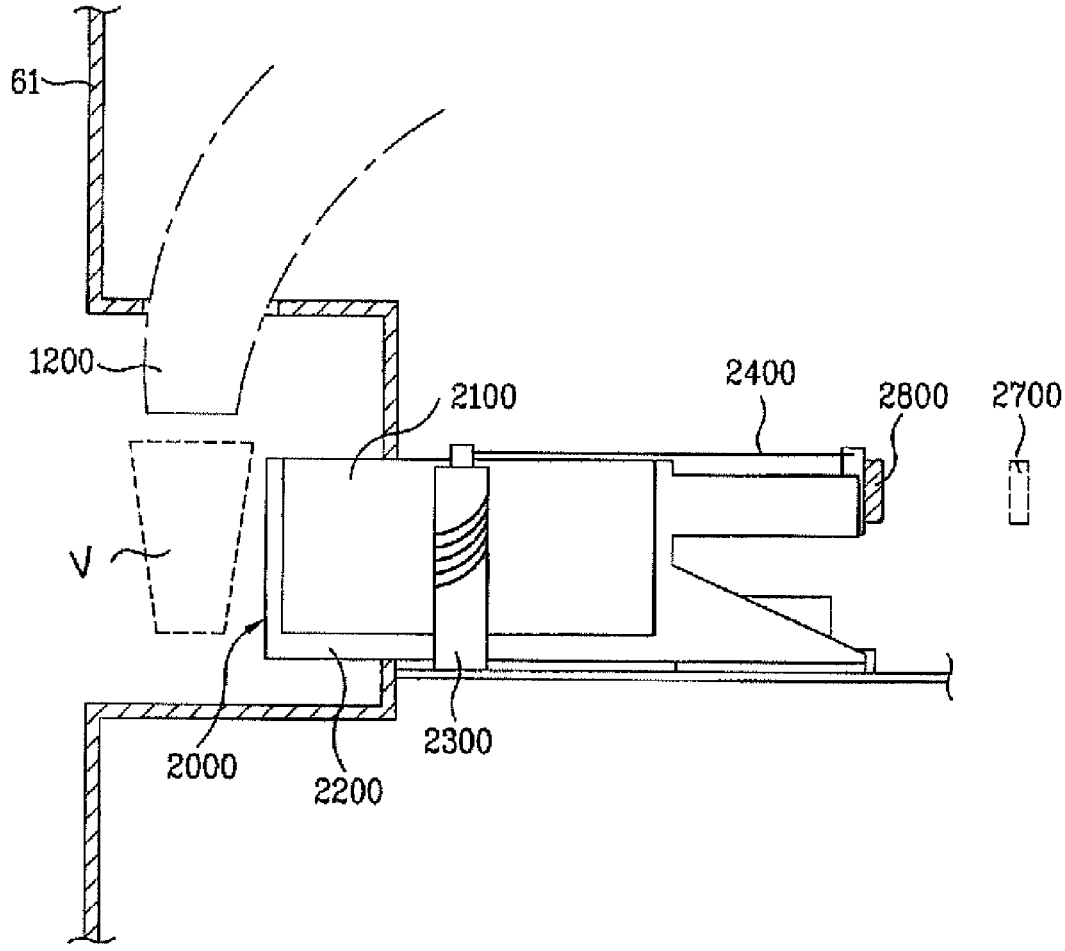

【Fig. 9】
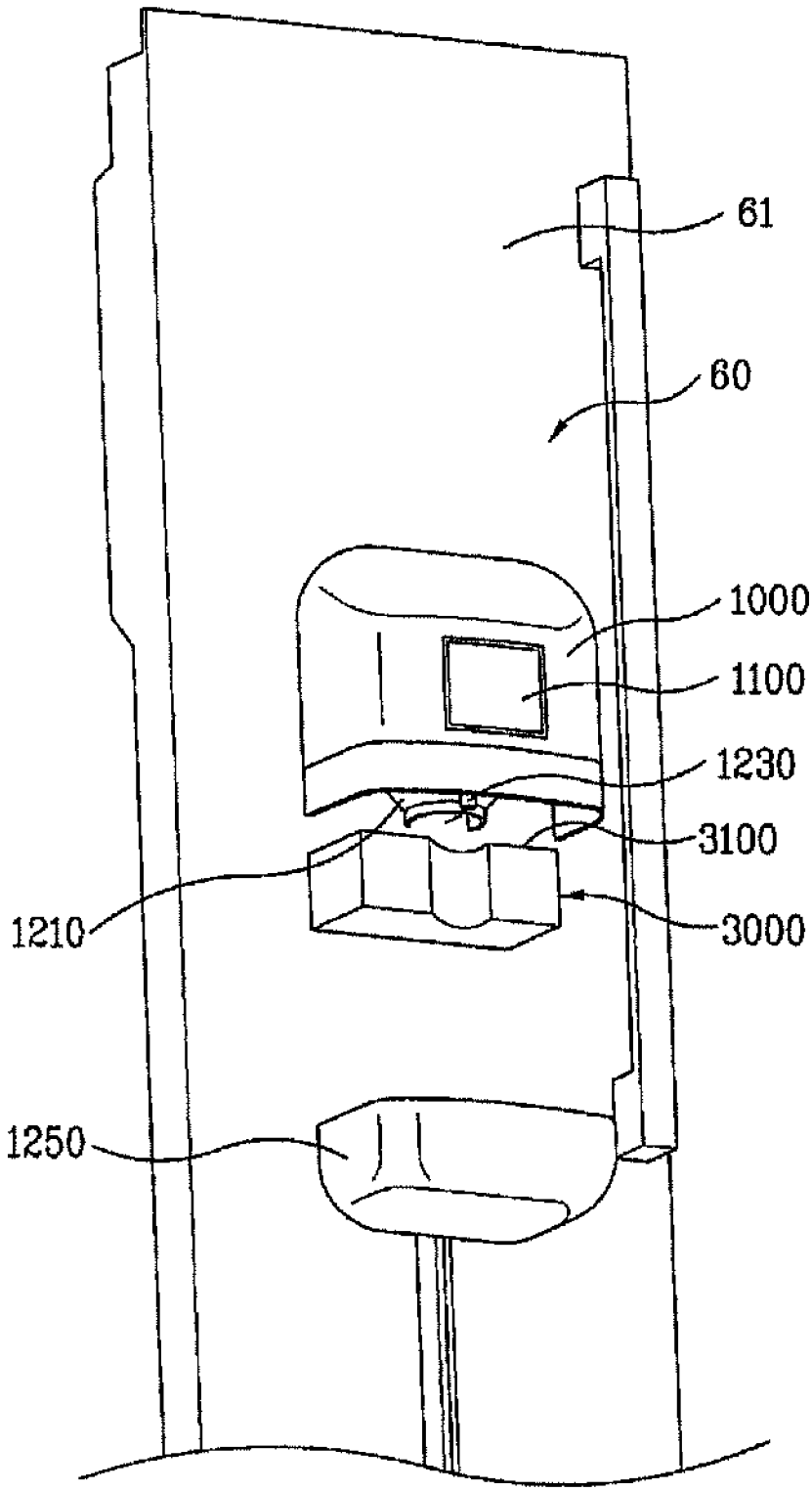

【Fig. 10a】
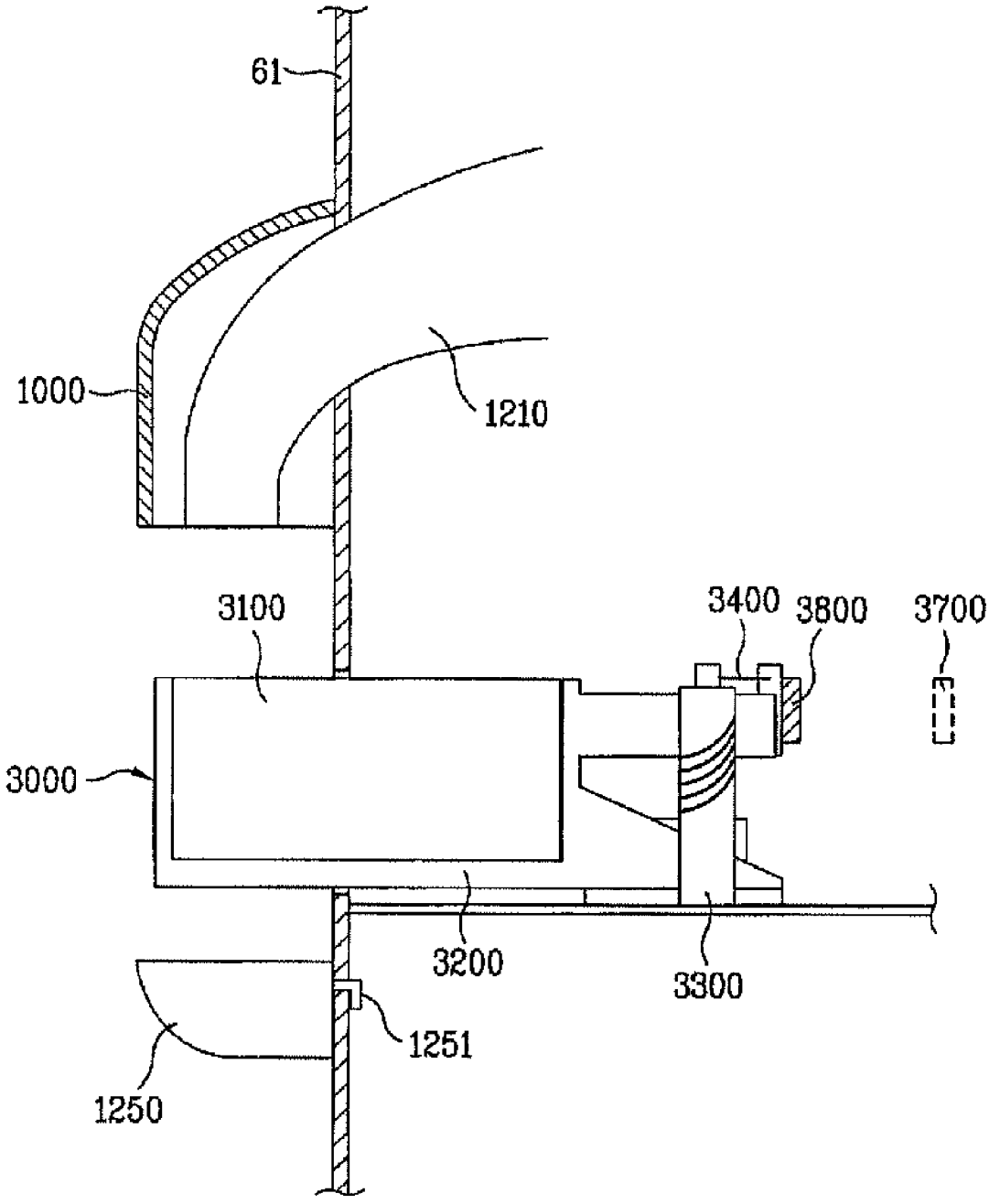

【Fig. 10b】
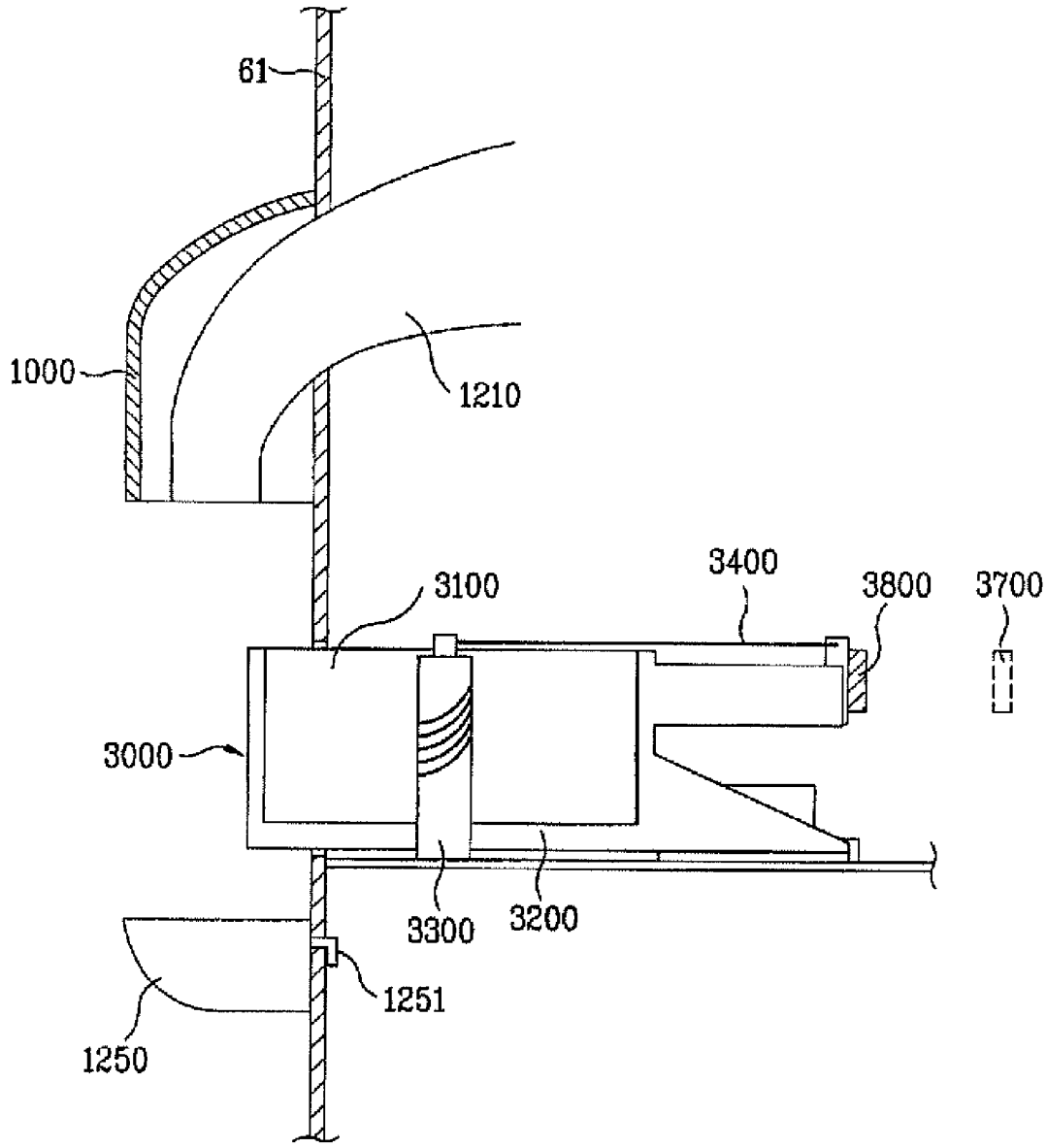

DISPENSER RELATED TECHNOLOGY

CROSS REFERENCE TO RELATED APPLICATIONS

This application claims the benefit of U.S. Provisional Application No. 60/950,377, filed on Jul. 18, 2007, and Korean Patent Application No. 10-2007-0067635, filed on Jul. 5, 2007, each of which are hereby incorporated by reference for all purposes as if fully set forth herein.

FIELD

The present disclosure relates to dispenser technology.

BACKGROUND

A refrigerator is a representative food storing apparatus. Generally, a refrigerator includes a freezing compartment and a refrigerating compartment. The refrigerating compartment is kept at a temperature of about 3 to 4° C., to store food and vegetables in a fresh state for a prolonged period of time. The freezing compartment is kept at a temperature of below zero, to store meat and other food in a frozen state. A refrigerator may include an ice maker configured to make ice and a dispenser configured to dispense liquid water and ice made by the ice maker.

SUMMARY

In one aspect, an appliance includes a compartment, a door configured to open and close at least a portion of the compartment, and a dispenser that is positioned on a surface of the door and that is configured to dispense content through a dispenser outlet. The appliance also includes a button tray composite device that includes a moveable receiving tray portion that is configured to move, at least partially toward and away from the door surface, in response to application of force against the moveable receiving tray portion, a dispenser control mechanism configured to respond to repositioning of the moveable receiving tray portion by affecting an amount of content dispensed through the dispenser outlet, and a tray movement control mechanism configured to move the moveable receiving tray portion away from the door surface in the absence of force applied to the moveable receiving tray portion in a direction that is toward the door surface, and to change a position of the moveable receiving tray portion from a first position that is misaligned with the dispenser outlet in response to force that is applied to the moveable receiving tray portion to a receiving position that is aligned with and captures content dispensed through the dispenser outlet in response to removal of force that is applied to promote positioning of the moveable receiving tray portion in the first position.

Implementations may include one or more of the following features. For example, affecting an amount of content dispensed through the dispenser outlet may include controlling whether or not content is dispensed through the dispenser outlet. Affecting an amount of content dispensed through the dispenser outlet also may include regulating dispensing of content through the dispenser outlet from among at least three settings. The three settings may include a first setting in which content is not dispensed through the dispenser outlet, a second setting in which content is dispensed through the dispenser outlet at a first rate, and a third setting in which content is dispensed through the dispenser outlet at a second rate that is different than the first rate.

In some implementations, the tray movement control mechanism may be configured to move the moveable receiving tray portion away from the door surface by rotating the moveable receiving tray portion away from the door surface about a pivot point. The tray movement control mechanism may be configured to move the moveable receiving tray portion away from the door surface by extending the moveable receiving tray portion away from the door surface in a plane perpendicular to the door surface.

In some examples, the moveable receiving tray portion may have a structure defining a content receiving space configured to receive and store content, the dispenser control mechanism may include a button switch configured to facilitate control over the dispenser to dispense content through the dispenser outlet, and the tray movement control mechanism may include a tray drive mechanism configured to move, in response to release of force applied to the moveable receiving tray portion, the moveable receiving tray portion to the receiving position. In these examples, the appliance may include a dispensing switch that is positioned to contact the button switch in response to movement of the moveable receiving tray portion, and that is configured to control the dispenser to dispense content through the outlet in response to being contacted by the button switch.

Further, the tray drive mechanism may include an elastic member having an elastic resilience against an external force applied to the moveable receiving tray portion. The button tray composite device also may include a guide member configured to guide the movement of the moveable receiving tray portion along a guided direction.

The button tray composite device further may include a moving member that is selectively coupled to the moveable receiving tray portion, which is configured to move together with the moveable receiving tray portion in the guided direction when the moveable receiving tray portion is coupled to the moving member, and which is otherwise configured to remain stationary relative to the moveable receiving tray portion in the guided direction, and a coupler configured to couple the moveable receiving tray portion to the moving member. The coupler may include a first coupling member mounted to one of the moveable receiving tray portion and the moving member, the first coupling member having magnetic properties, and a second coupling member that has metallic or magnetic properties and that is mounted to the other of the moveable receiving tray portion and the moving member such that the second coupling member is configured to be coupled to the first coupling member by a magnetic force.

In some implementations, the tray drive mechanism may include a roller configured to rotate, and a wire spring wound around a portion of the roller and configured to unwind from the roller in response to the force applied to the moveable receiving tray portion, and to again wind around the roller and thus promote movement of the moveable receiving tray portion to the receiving position in response to release of the force applied to the moveable receiving tray portion. A first end of the wire spring may be coupled to a moving member that is configured to move together with the moveable receiving tray portion, and a second end of the wire spring may be coupled to the roller.

The dispenser may include a moving chute that is configured to move between an operable position in which the moving chute is at least partially positioned on a side of the door surface opposite of the compartment, and a stored position in which the moving chute is positioned entirely on a side the door surface where the compartment is positioned, where the moving chute has structure that defines at least a portion of a passage through which content is discharged from the appliance. The moveable receiving tray portion may have structure defining a content receiving space configured to receive and store content, and the moveable receiving tray portion may be configured to move to a position in which at least a portion of the moveable receiving tray portion is positioned on the side of the door surface opposite of the compartment when the moving chute moves from the stored position to the operable position.

A tray holder may be configured to move the moveable receiving tray portion of the button tray composite device into a space defined within a frame of the door when the moving chute moves from the operable position to the stored position. The tray holder may be coupled to one side of a moving member that is configured to move together with the moveable receiving tray portion.

In some examples, the dispenser may include a dispensing cover arranged further from the compartment than the moving chute and configured to move with the moving chute, and a cover fixing unit that is configured to, when the moving chute is positioned in the operable position, prevent the dispensing cover from being moved by a force lower than a predetermined force, and that is configured to, when the moving chute is positioned in the operable position, allow the moving chute to move from the operable position toward the stored position in response to a force higher than the predetermined force. In these examples, the cover fixing unit may include an extension member configured to move with the moving chute, a first coupling member mounted to one side of the extension member, and a second coupling member installed in the inner space of the door such that the second coupling member is coupled to the first coupling member to prevent the dispensing cover from being moved by a force lower than the predetermined force and is uncoupled from the first coupling member in response to a force higher than the predetermined force. The first and second coupling members may be coupled by a magnetic force.

The door may have at least a portion extending into a dispensing cavity that houses the dispenser positioned on the door surface, and the outlet of the dispenser may be arranged in the dispensing cavity. The outlet of the dispenser may be positioned outside of a surface of the door that is furthest from the compartment.

In another aspect, a method for controlling an appliance includes causing a dispenser to dispense content in response to a button tray being pushed at least a particular distance from an original position in which the button tray is aligned with an outlet of the dispenser and configured to receive content dispensed by the dispenser to a first position in which the button tray is misaligned with the outlet of the dispenser, and moving, in response to release of a force that caused the button tray to be pushed at least the particular distance, the button tray from the first position toward the original position in which the button tray is aligned with the outlet of the dispenser and configured to receive content dispensed by the dispenser to enable the button tray to receive a residual content dispensed by the dispenser.

Implementations may include one or more of the following features. For example, the method may include coordinating movement, together with the button tray, of a moving chute that defines a content discharge passage and that is positioned above the button tray when the appliance is oriented in an ordinary operating position. The method also may include, after causing the dispenser to dispense content, receiving the moving chute and the button tray into an inner space defined in a door of the appliance.

In yet another aspect, an appliance includes a dispenser a button tray configured to cause the dispenser to dispense content in response to being pushed at least a particular distance from an original position in which the button tray is aligned with an outlet of the dispenser and configured to receive content dispensed by the dispenser to a first position in which the button tray is misaligned with the outlet of the dispenser, and a tray drive mechanism configured to move, in response to release of a force that caused the button tray to be pushed at least the particular distance, the button tray from the first position toward the original position in which the button tray is aligned with the outlet of the dispenser and configured to receive content dispensed by the dispenser.

DESCRIPTION OF DRAWINGS

FIG. 1 is a perspective view illustrating a food storing apparatus.

FIG. 2 is a perspective view of a part of the food storing apparatus of FIG. 1 corresponding to a front surface of a door, illustrating a state in which a dispenser included in the food storing apparatus is in an operable position.

FIG. 3A is a sectional view illustrating a state in which a button tray composite device is in a stored position.

FIG. 3B is a sectional view illustrating a state in which a button tray composite device is in an operable position.

FIG. 4A is a perspective view illustrating a button tray composite device.

FIG. 4B is an exploded perspective view illustrating a button tray composite device.

FIG. 5A is a sectional view of a button tray, illustrating a state in which the button tray is in an operable position.

FIG. 5B is a sectional view of a button tray illustrating a state in which the button tray is being moved from a position illustrated in FIG. 5A to a stored position.

FIG. 6A is a sectional view of a dispenser illustrating a state in which the dispenser is in a stored position.

FIG. 6B is a sectional view of a dispenser illustrating a state in which the dispenser is in an operable position.

FIG. 7 is a perspective view of a part of a food storing apparatus illustrating a front surface of a door.

FIG. 8A is a sectional view illustrating a state in which a button tray composite device is in an extended position.

FIG. 8B is a sectional view illustrating a state in which a button tray composite device is in a withdrawn position.

FIG. 9 is a perspective view of a part of a food storing apparatus illustrating a front surface of a door.

FIG. 10A is a sectional view illustrating a state in which a button tray composite device is in an extended position.

FIG. 10B is a sectional view illustrating a state in which a button tray composite device is in a withdrawn position.

DETAILED DESCRIPTION

FIG. 1 illustrates a food storing apparatus, such as a refrigerator. The refrigerator includes a freezing compartment configured to store food at a temperature below freezing and a refrigerating compartment configured to store food at a cool temperature that is higher than freezing. The refrigerator includes a freezing compartment door 50 arranged at a front side of the freezing compartment and configured to open and close the freezing compartment and refrigerating compartment doors 60 and 70 arranged at a front side of the refrigerating compartment and configured to open and close the refrigerating compartment. The freezing compartment is positioned beneath the refrigerating compartment when the refrigerator is oriented in a typical operating position. The refrigerating compartment may be divided into two blocks.

In implementations in which the refrigerating compartment is divided in two blocks, the refrigerating compartment includes a first refrigerating compartment and a second refrigerating compartment. In these implementations, the refrigerating compartment door 60 is a first refrigerating compartment door configured to open and close the first refrigerating compartment, whereas the refrigerating compartment door 70 is a second refrigerating compartment door configured to open and close the second refrigerating compartment. The first and second refrigerating compartment doors 60 and 70 are pivotally coupled to opposite side walls of a refrigerator body by hinges such that the doors 60 and 70 may be pivotally opened and closed. The freezing compartment door 50 is opened and closed in a sliding manner in forward and rearward directions of the refrigerator body.

The freezing and refrigerating compartment doors may be arranged at various positions in accordance with the positions of the freezing and refrigerating compartments. For example, the refrigerator may include various styles of refrigerators, for example, a refrigerator with a top mount freezing compartment and side-by-side style refrigerators that include side-by-side refrigerating and freezing compartments.

A dispenser 100 is located at a front side of the refrigerating compartment door 60, and configured to dispense certain content, such as, water or ice. A button tray composite device 200 is located beneath the dispenser 100, and configured to receive a residual content left in the dispenser 100 after dispensation of water or ice.

FIG. 2 illustrates a part of the food storing apparatus of FIG. 1 corresponding to a front surface of a door. As shown in FIG. 2, the dispenser is in an operable position.

The first refrigerating compartment door 60 includes a front frame 61 and a rear frame 63. The front frame 61 is partially exposed to the outside of the refrigerator, whereas the rear frame 63 is partially exposed to the inside of the refrigerator body when the refrigerating compartment door 60 is in a closed position.

A space is defined between the front frame 61 and the rear frame 63. In the space, an ice maker (not shown), which produces ice, an ice storing container (not shown), which stores the ice produced by the ice maker, and a water tank, which stores water, are installed. In some examples, the ice maker, ice storing container, and water tank may be installed in the refrigerator body, or installed at the freezing compartment door 50.

The dispenser 100 is positioned on the door and at least a portion of the dispenser is configured to fit in the space defined between the front frame 61 and the rear frame 63 when the dispenser is in a stored position. The dispenser 100 also is connected to the water tank and ice storing container to receive water or ice for dispensing.

The dispenser 100 includes a moving chute 120 configured to move between a stored position and an operable position. In the operable position, at least a portion of the moving chute 120 is positioned outside of the front frame 61, and the moving chute 120 is configured to define a passage for discharging ice through the door. In the stored position, at least a portion of the moving chute 120 is positioned in the space defined between the front frame 61 and the rear frame 63. The dispenser 100 also includes a dispensing cover 110, which may be configured to move between a stored position and an operable position together with the moving chute 120. In the stored position, the dispensing cover 110 may be positioned flush with a surface of the door.

Control buttons 113 and a display 111 are arranged on the dispensing cover 110. The control buttons 113 control various dispenser and/or refrigerator functions. For instance, the control buttons 113 may control a selection of content for dispensing, for example, selection of ice or water. The display 111 displays a content dispensation state and any other information related to the dispenser 100 or the refrigerator.

A transparent panel 115 is positioned on the dispensing cover 110, to allow a user to visually check the button tray composite device at an outside of the refrigerator. Through the transparent panel 115, the user may visually check how much content discharged through an outlet included in the moving chute 120 is received in a container. The transparent panel 115 enables a user to view ice or water being dispensed into a container to ensure the container is positioned such that the ice or water being dispensed is received in the container and also to determine when to stop dispensing because the container has been filled to a desired level.

In some implementations, a separate illumination device may be installed in an inner space of the door. In these implementations, the illumination device may operate to emit light, only when content (e.g., ice or water) is being dispensed, in order to allow the user to check how much content is received in a container. Further, in these implementations, the dispensing cover 110 may be made of a material that allows light to pass through the dispensing cover 110.

As shown in FIG. 2, the dispensing cover 110 and moving chute 120 are structurally connected (e.g., integrated). For instance, the dispensing cover 110 and moving chute 120 constitute a single dispensing housing. The dispensing cover 110 defines an external appearance of the dispensing housing, whereas the moving chute 120 defines an interior of the dispensing housing. In these configurations, the dispensing cover 110 and moving chute 120 move together. In particular, the moving chute 120 moves to enter or exit the inner space of the door.

FIG. 3A illustrates a button tray composite device in a stored position and FIG. 3B illustrates a button tray composite device in an operable position. The dispenser 100 includes a fixed chute 130 having a first end that communicates with the moving chute 120, and a second end that communicates with the ice storing container, which stores ice. The fixed chute 130 is positioned in the space defined between the front frame 61 and the rear frame 63. The fixed chute 130 is fixed in the space by fasteners (not shown), for example, bolts and nuts, or hooks.

The moving chute 120 has a length enabling the moving chute 120 to communicate with the fixed chute 130 during movement of the moving chute 120, irrespective of whether the moving chute 120 is in an operable position outside of the front frame 61 or in a stored position in the inner space of the door defined between the front frame 61 and the rear frame 63.

An ice discharge duct (not shown) may be positioned in the space defined between the front frame 61 and the rear frame 63, to define an ice flow passage from the ice storing container to the fixed chute 130. A duct cover (not shown) may be located at an end of the ice discharge duct that communicates with the fixed chute 130, and configured to open and close the ice discharge duct.

A mechanical drive mechanism is provided at the refrigerating compartment door 60. The mechanical drive mechanism is configured to move the dispensing cover 110 and moving chute 120 from a stored position to an operable position in which the dispensing cover 110 and moving chute 120 are positioned outside of the front frame 61.

The mechanical drive mechanism includes a hinge 170 that allows the dispensing cover 110 connected to the moving chute 120 to pivot or rotate with respect to the front frame 61, and an elastic device (not shown) that provides an elastic force to the dispensing cover 110 and moving chute 120 to promote movement of the dispensing cover 110 and moving chute 120 from the stored position to the operable position in which the dispensing cover 110 and moving chute 120 are positioned outside of the front frame 61. The mechanical drive mechanism also includes a coupling unit that couples the dispensing cover 110 to the front frame 61 against the elastic force provided by the elastic device, thereby retaining the dispensing cover 110 and moving chute 120 in the stored position when the coupling unit is engaged.

The coupling unit includes a first coupler 181 mounted to the dispensing cover 110, and a second coupler 183 mounted in the inner space of the door. The first and second couplers 181 and 183 operate to be engaged or separated from each other, upon receiving a force from a user.

For example, when the first and second couplers 181 and 183 are simultaneously pressed, a coupling hook provided at the second coupler 183 is separated from a coupling groove provided at the first coupler 181. When the first coupler 181 is separated from the second coupler 183 and pressed, the coupling hook engages the coupling groove, thereby coupling the first coupler 181 to the second coupler 183.

The mechanical drive mechanism may further include a damper (not shown) for adjusting the speed of the dispensing cover during the movement of the dispensing cover 110. The damper may be any device configured to apply a constant force to the dispensing cover 110 and moving chute 120 such that the dispensing cover 110 and moving chute 120 pivot at a constant speed. For example, a gas spring or a gearing may be used, which may apply a relatively constant force to the dispensing cover 110 and moving chute 120 against the pivotal movement of the dispensing cover 110 and moving chute 120.

The hinge 170 includes hinge pins (not shown) respectively located at opposite ends of the dispensing cover 110, and hinge grooves (not shown) located at an inner surface of the front frame 61 such that the hinge grooves correspond to the hinge pins, respectively. Accordingly, the dispensing cover 110 and moving chute 120 pivot about the hinge pins.

The refrigerator further may include a water discharge duct (not shown) coupled to the dispensing cover 110, and configured to discharge water. When the dispensing cover 110 and moving chute 120 are in an operable position outside of the front frame 61 (e.g., in a water dispensing mode), the water discharge duct (not shown) coupled to the dispensing cover 110 is positioned together with the dispensing cover 110 and moving chute 120, so that water can be discharged out of an outlet of the water discharge duct outside of the front frame 61.

The button tray composite device 200, which is located beneath the dispenser 100, controls the dispensation of content (e.g., ice or water) discharged out of an outlet 121 of the moving chute 120. The button tray composite device 200 also is configured to receive a residual content discharged from the outlet 121 after the completion of a content dispensing operation.

A controller (not shown) is located at one side in the inner space of the door. The controller includes a dispensing switch 270 configured to control dispensation of content, in cooperation with the button tray composite device 200.

The button tray composite device 200 includes a button switch 280 that is selectively connectable to the dispensing switch 270 to control the dispensation of the content. The button tray composite device 200 also includes a button tray 210 having a content receiving space configured to receive content (e.g., residual content after a dispensing operation) from the outlet 121 when the button tray 210 is in an extended position corresponding to and positioned under the outlet 121. The button tray composite device 200 further includes a tray driving mechanism configured to move the button tray 210.

The button tray composite device 200 includes a guide member 250 configured to guide the movement of the button tray 210. A moving member 220, which may be selectively coupled to the button tray 210, is configured to move, together with the button tray 210, while being guided by the guide member 250.

FIG. 4A illustrates a button tray composite device and FIG. 4B is an exploded perspective view illustrating a button tray composite device. As shown, the button tray 210, which has the content receiving space configured to receive a residual content, also has a front panel having a curved portion 211 that allows the front panel to easily come into contact with a container to receive the dispensed content. The curved portion 211 defines a concave space in the button tray 210 that is shaped to accommodate a portion of a typical container such that the button tray may be effectively contacted with and thus actuated by a container.

The moving member 220 includes a bottom wall 223 that defines a bottom of the button tray 210, and supports the bottom of the button tray 210. A rear wall 225 is connected to (e.g., integrated with) the bottom wall 223, and supports the rear side of the button tray 210.

A guide groove 227 is defined (e.g., formed) in the bottom wall 223 of the moving member 220, at a lower surface thereof, and corresponds to the guide member 250. When the moving member 220 moves, the guide groove 227 of the moving member 220 slides along the guide member 250, thereby guiding the movement of the moving member 220.

The button tray 210 is coupled to the moving member 220 by a coupler. Accordingly, when an external force is applied to the button tray 210, the moving member 220 is moved, together with the button tray 210.

In some implementations, the coupler includes a first coupling member 261, which is mounted to a rear panel of the button tray 210, and has magnetic properties, and a second coupling member 263 mounted to the rear wall 225 of the moving member 220. The second coupling member 263 may be coupled to the first coupling member 261 by a magnetic force generated from the first coupling member 261. The first coupling member 261 may comprise a permanent magnet or an electromagnet, whereas the second coupling member 263 may comprise a permanent magnet, an electromagnet, or a metallic member.

In other examples, the coupling between the moving member 220 and the button tray 210 may be achieved using another coupling method that enables the moving member 220 and the button tray 210 to be coupled and uncoupled. For example, the moving member 220 and button tray 210 may be coupled by a hook coupling method or a thread coupling method.

The button switch 280 is mounted to the moving member 220 such that it is selectively connectable to the dispensing switch 270. For example, when the button switch 280 comes into contact with the dispensing switch 270 as the moving member 220 moves, the dispensing switch 270 generates a signal, and sends the generated signal to the controller. In response to the signal, the controller controls the dispensation of the content (e.g., ice, water, etc.).

The tray drive mechanism includes an elastic member having an elastic resilience against an external force applied to the button tray 210. A wire spring may be used for the elastic member.

The tray drive mechanism includes a roller 230 installed at one side in the interior of the door, and a wire spring 240 wound around the roller 230. The wire spring 240 is unwound from the roller 230 when an external force is applied to the tray drive mechanism, and is wound around the roller 230 when the external force is released. When the wire spring 240 is wound around the roller 230, it applies a force that moves the button tray 210. As shown in FIG. 4*a*, the tray drive mechanism includes a pair of rollers 230 installed at opposite sides in the interior of the door, and a pair of wire springs 240 wound around the rollers 230, respectively. Although the description focuses on a single roller 230 and a single wire spring 240, the described techniques may be applied when two or more rollers and wire springs are used.

The wire spring 240 is coupled, at one end thereof, to a spring support 221 provided at the moving member 220, and is coupled, at the other end thereof, to the roller 230. The roller 230 includes a rotating body 233, and a rotating shaft 231 that defines a rotating axis of the rotating body 233. The tray drive mechanism may further include a torsion spring (not shown) mounted to the roller 230, to return the rotating body 233 from a rotated state (e.g., a state in which the wire spring 240 is unwound) to an original state (e.g., a state in which the wire spring 240 is wound around the rotating body 233).

In accordance with the above-described configuration, when the button tray 210 moves in response to an external force applied thereto (e.g., a force applied by a user), the moving member 220 that is coupled to the button tray 210 moves together with the button tray 210. During movement of the moving member 220, the wire spring 240 coupled to the moving member 220 is made tense. Namely, a tension is applied to the wire spring 240, so that the wire spring 240 is gradually unwound from the roller 230 due to rotation of the roller 230 caused by the tension.

When the external force is subsequently released, the wire spring 240 is wound around the roller 230 by the resilience of the wire spring 240 or torsion spring. At this time, the moving member 220 coupled to the wire spring 240 moves to an original position where the moving member 220 was positioned before the application of the external force.

The elastic member that provides resilience to the tray may have any shape. For example, a spring having a structure different from the above-described structure, such as a coil spring or a plate spring, may be used for the elastic member.

In some implementations, the elastic member may be arranged such that one end thereof is coupled to the moving member, and the other end thereof is positioned in the inner space of the door. In these implementations, when the button tray 210 is pushed into the inner space of the door by an external force (e.g., a force applied by a user with a container), the elastic member is completely positioned in the inner space of the door in a compressed state. In the compressed state, the elastic member has a resilience that, when the external force is removed from the button tray 210, causes the elastic member to return to an original or uncompressed state while pushing the button tray 210 in a direction outside of the inner space of the door.

The operation of the button tray composite device will be described below with reference to FIGS. 2 to 4*b*.

When a user desires to dispense content, e.g., ice or water, the user presses the lower end of the dispensing cover 110. For instance, the user presses a portion of the dispensing cover 110 that corresponds to a position where the couplers 181 and 183 that couple the dispensing cover 110 to the front frame 61 are arranged.

In response to the user pressing the portion of the dispensing cover 110, the dispensing cover 110 and button tray 210 simultaneously move outward from the front frame 61. At this time, the dispensing cover 110 is protruded outwardly from the front frame 61 by the resilience of the elastic device mounted to the moving chute drive mechanism, and the button tray 210 is protruded outwardly from the front frame 61 by the resilience of the elastic member included in the tray drive mechanism, e.g., the wire spring 240.

When the user subsequently brings a container into contact with the button tray 210, and pushes the button tray 210 in a direction into the door with the container, the moving member 220 coupled to the button tray 210 is moved in the direction into the door along the guide member 250, together with the button tray 210. During the movement of the moving member 220, the wire spring 240 is unwound from the roller 230 in accordance with the movement of the moving member 220.

When the moving member 220 reaches a predetermined position, the button switch 280 mounted to the button tray 210 contacts or connects with the dispensing switch 270 arranged in the interior of the door. In response to a signal generated in response to the connection between the button switch 280 and the dispensing switch 270, the controller performs a control operation to dispense content (e.g., ice or water) through the outlet 121.

In this example, the controller controls dispensing of content in such a manner that the content is dispensed through the outlet 121 only when the moving chute 120 is in an operable position (e.g., rotated outside of the front frame 61). That is, the content is not dispensed when the moving chute 120 and button tray 210 are arranged in the interior of the door, even if the button switch 280 mounted to the button tray 210 contacts or connects with the dispensing switch 270.

The signal may be generated, based on information including the contact time of the connection between the button switch 280 and the dispensing switch 270 or the contact position. For instance, content may be dispensed as long as the connection between the button switch 280 and the dispensing switch 270 remains. In some examples, dispensing of content does not begin until the connection between the button switch 280 and the dispensing switch 270 has existed for a threshold period of time (e.g., one second). In these examples, dispensing of content is delayed for the threshold period of time, which may avoid content from being dispensed as a result of an inadvertent movement of the button tray 210.

In other examples, the dispensing of content does not begin until the button switch 280 contacts the dispensing switch 270 at a particular portion of the dispensing switch 270. For example, dispensing of content may not occur until the button switch 280 contacts a rear portion of the dispensing switch 270 positioned further into the door. In this example, dispensing of content occurs for relatively large movement of the button tray 210, but does not occur for relatively small movement of the button tray 210, which may avoid content from being dispensed as a result of an inadvertent movement of the button tray 210.

An amount or a rate of content being dispensed by the dispenser also may be controlled using the button tray 210. For example, depending on the position of the button tray 210, the dispensing of content may be regulated from among at least three settings (e.g., an off setting, a fully on setting, and a partially on setting). In this example, no movement of the button tray 210 may result in a first setting in which content is not dispensed, a relatively small movement of the button tray 210 may result in a second setting in which content is dispensed at a first rate, and a relatively large movement of the button tray 210 may result in a third setting in which content is dispensed at a second rate that is different than the first rate. The second rate may be larger than the first rate and allow a container to be filled more quickly in response to a relatively large movement of the button tray.

When the user releases the container, in which the content has been received, from the button tray 210 after a dispensing operation, the moving member 220 and button tray 210 move, by the resilience of the wire spring 240, to the original positions thereof (e.g., positions prior to the movement caused by user application of force with the container in performing the dispensing operation). The original position may be a position beneath the outlet 121.

When the button tray 210 is returned to the original position beneath the outlet 121, a residual content discharged out of the outlet 121 just after the dispensation of the content is received and contained in the button tray 210. Accordingly, the residual content is not dropped onto the floor.

In other words, the button tray 210 moves from a position in which the button tray 210 is misaligned with the outlet 121 to a position in which the button tray 210 is aligned with the outlet 121. In the misaligned position, the button tray 210 is not configured to receive content discharged from the outlet 121. However, in the aligned position, the button tray 210 is configured to receive content discharged from the outlet 121. By moving the button tray 210 from the misaligned position to the aligned position after dispensing of content (e.g., as or after a user removes force supplied with a container to the button tray 210), the button tray 210 may receive residual content dispensed through the outlet 121 in the aligned position. In the aligned position otherwise unguided content dispensed for the outlet 121 falls into the button tray 210 in an ordinary operating orientation and use of the food storing apparatus/refrigerator, and in the misaligned position otherwise unguided content dispensed for the outlet 121 falls into the button tray 210 in an ordinary operating orientation and use of the food storing apparatus/refrigerator.

Movement of the button tray 210 may follow a path different from the path of the button tray 210 described above. As described above, the button tray 210 retracts and extends toward and away from a surface of the door in a plane perpendicular to the door surface. In some implementations, the button tray 210 also may rotate or pivot toward and away from the door surface about a pivot point or extend and retract in a plane that is not perpendicular to the door surface.

When the user subsequently pushes the dispensing cover 110 in a direction into the door such that the moving chute 120 and button tray 210 are inserted into the inner space of the door, the couplers 181 and 183 are coupled to each other, so that the dispensing cover 110 is coupled to the front frame 61 in a stored position. Even in the stored position, the button tray 210 may receive a residual content, which may be discharged out of the outlet 121, because the button tray 210 may remain positioned beneath the outlet 121.

Thus, the button tray 210 may reliably receive a residual content that occurs after a dispensing operation because the button tray 210 may always be positioned beneath the outlet 121 (or in another position in which the button tray 210 receives content dispensed from the outlet 121), irrespective of whether the button tray 210 is in an operable position protruded outwardly from the front frame 61 or in a closed position inserted into the inner space of the door.

FIG. 5A illustrates a state in which the button tray is in an operable position, and FIG. 5B illustrates a state in which the button tray is being moved from a position illustrated in FIG. 5A to a stored position. The food storing apparatus shown in FIGS. 5*a* and 5*b* includes a button tray 210, a moving member 220, a moving chute 120, and a dispensing cover 110, as described above.

In the implementation illustrated in FIGS. 5*a* and 5*b*, the button tray composite device 200 includes a tray holder 229 coupled to one side of the moving member 220, to prevent the dispensing cover 110 from coming into contact with the button tray 210 when the moving chute 120 is inserted into the interior of the door. That is, the tray holder 229 is configured to move the button tray 210 into the inner space of the door in accordance with movement of the moving chute 120.

If the tray holder 229 is not used, the inner surface of the dispensing cover 110 may come into contact with the button tray 210 when the user pushes the dispensing cover 110 to cause the moving chute 120 and button tray 210 to be inserted into the inner space of the door. Such contact may result in damage to the dispensing cover 110 and button tray 210.

The tray holder 229 includes a first extension member 229*a* coupled to the rear wall 225 of the moving member 220 or extending from the moving member 220, and a second extension member 229*b* extending upwardly from the first extension member 229*a* in a bent state. The first extension member 229*a* and the second extension member 229*b* may form an "L" shape.

When the moving member 220 moves, the first extension member 229*a* moves together with the moving member 220 because they are coupled to each other. When the moving chute 120 moves, the second extension member 229*b* moves in accordance with the movement of the moving chute 120.

The moving chute 120 and button tray 210 move to an operable position in which at least a portion of the moving chute 120 and button tray 210 are positioned outside of the front frame 61 of the door using the techniques described above. However, when the moving chute 120 moves to a closed position in which the moving chute 120 is inserted into the inner space of the door, the following operation may be performed.

When the user pushes the dispensing cover 110, the moving chute 120 is moved into the inner space of the door, as shown in FIG. 5A. Based on this movement, the moving chute 120 comes into contact with the second extension member 229*b* before the inner surface of the dispensing cover 110 comes into contact with the button tray 210. When the user further pushes the dispensing cover 110, the moving chute 120 pushes the second extension member 229*b*.

As a result, the second extension member 229*b* is pushed into the inner space of the door in accordance with the movement of the moving chute 120. The movement of the second extension member 229*b* imparts force to the first extension member 229*a*, which causes the first extension member 229*a* and the moving member 220 to move into the inner space of the door. In accordance with the movement of the moving member 220, the button tray 210 coupled to the moving member 220 also moves into the inner space of the door.

A separate pad may be arranged in a region where the second extension member 229*b* comes into direct contact with the moving chute 120, in order to prevent the moving chute 120 from being damaged in the contact region. The pad may be attached to the second extension member 229*b* or moving chute 120 in the contact region.

FIG. 6A illustrates a state in which a dispenser is in a stored position, and FIG. 6B illustrates a state in which a dispenser is in an operable position. As shown, the refrigerator includes a dispenser configured to move from a stored position to an operable position that is outside of a front frame of the door, and a button tray composite device 200 configured to receive a residual content discharged after the content dispensation through the outlet 121 of the dispenser. The content may include water or ice.

The dispenser includes a moving chute 120, which is configured to move outward from the front frame 61 to form a passage for discharging ice through the door when the moving chute 120 is used to dispense a content, and is configured to be inserted into an inner space of the door when the moving chute 120 is not used and in a stored position. The dispenser 100 also includes a dispensing cover 110 mounted to a front side of the moving chute 120 such that the dispensing cover 110 moves together with the moving chute 120.

The dispenser may further include a cover fixing unit 190 that prevents the dispensing cover 110 from being moved by a force lower than a predetermined external force in a state in which the dispensing cover 110 is protruded outwardly from the front frame of the door.

The cover fixing unit 190 includes an extension member 193, which moves together with the moving chute 120, a first coupling member 191 mounted to one side of the extension member 193, and a second coupling member 192 installed in the inner space of the door such that the second coupling member 192 may be selectively coupled to the first coupling member 191.

One of the first and second coupling members 191 and 192 comprises an article having magnetic properties, whereas the other of the first and second coupling members 191 and 192 comprises an article having magnetic properties or a metallic article. That is, the first and second coupling members 191 and 192 are coupled by a magnetic force such that a particular force must be applied to the extension member 193 to overcome the magnetic force between the first and second coupling members 191 and 192 and allow movement of the extension member 193 and moving chute 120.

For example, the first coupling member 191 may comprise a permanent magnet or an electromagnet, whereas the second coupling member 192 may comprise a permanent magnet, an electromagnet, or a metal member.

The coupling force is proportional to the magnetic force. The predetermined external force corresponds to the coupling force of the first and second coupling members 191 and 192. The coupling force of the first and second coupling members 191 and 192, (e.g., the predetermined external force needed to move the extension member 193 and moving chute 120), is set to a force that is greater than a force typically applied (e.g., by a user) to a control button arranged on the dispensing cover 110.

The cover fixing unit 190 may be used to fix the dispensing cover 110. First, the dispensing cover 110 and moving chute 120 move to an operable position outside of the front frame of the door, before a content is discharged out of the outlet 121. In moving to the operable position, the extension member 193 moves together with the moving chute 120. Simultaneously with the completion of the movement of the moving chute 120 outward from the front frame of the door, the first coupling member 191 is coupled to the second coupling member 192 (e.g., by a magnetic force).

When the user presses the control button with a typical force in the coupled state of the first and second coupling members 191 and 192, for the dispensation of the content such as water or ice, the force applied to the control button is lower than the predetermined external force. Thus, the pressing of the control button does not result in movement of the dispensing cover 110.

When the force applied to the control button by the user is higher than the predetermined external force, the coupled state of the first and second coupling members 191 and 192 is released, and the dispensing cover moves toward a closed or stored position.

As described above, the button tray composite device includes a button tray 210, which controls the dispensation of the content, and receives a residual content, a moving member 220 coupled to the button tray 210, to move together with the button tray 210, a spring wire (not shown) for moving the moving member 220, and a roller 230, around which the spring wire is wound.

FIG. 7 illustrates a front surface of a door including a dispenser, FIG. 8A illustrates a state in which a button tray composite device is in an extended position, and FIG. 8B illustrates a state in which a button tray composite device is in a withdrawn position. The food storing apparatus shown in FIGS. 7-8*b* includes a dispenser having an outlet 1200 to discharge content, a door 60, at which the dispenser is installed, and a button tray composite device 2000 to control the dispensation of the content, and to receive a residual content discharged out of the outlet 1200 after content has been dispensed.

The button tray composite device 2000 includes a button switch 2800 to control the dispensation of content, a button tray 2100 that defines a content receiving space (e.g., a recess) to receive the residual content, and a tray drive mechanism to move the button tray 2100.

The button tray 2100 and tray drive mechanism (e.g., moving member 2200, roller 2300, and spring wire 2400) are similar to the button tray and tray drive mechanism described above. Accordingly, further description of the button tray 2100 and tray drive mechanism has not been provided.

The button switch 2800 is arranged at a rear end of the moving member. The button switch 2800 interacts with a dispensing switch 2700 installed in the inner space of the door 60, to generate a signal associated with an operation to control the dispensation of content.

In some implementations, the button switch 2800 and dispensing switch 2700 may function as distance sensors. For example, the button switch 2800 may comprise a first distance sensor mounted to a rear wall of the moving member, whereas the dispensing switch 2700 may comprise a second distance sensor arranged at a certain fixed position in the inner space of the door 60. In these implementations, when the first distance sensor moves, it interacts with the second distance sensor, to sense the movement distance of the button tray 2100. Based on the sensed movement distance, a controller may generate a signal to control the dispensation of content.

The door includes at least a portion extending into the inner space of the door, to form a recess or dispensing cavity S. The outlet 1200 is arranged in the recess or dispensing cavity S. The button tray 2100 is arranged below the outlet 1200.

As shown in FIG. 8A, the button tray 2100 is positioned beneath the outlet 1200 when no content is dispensed (e.g., the button tray 2100 is in an aligned position in which content dispensed from the outlet 1200 is received in the button tray 2100).

When the user pushes the button tray 2100 toward the inner space of the door 60, the button tray 2100 is partially inserted into the inner space of the door 60, as shown in FIG. 8B. At this time, the button switch 2800 contacts or is connected to the dispensing switch 2700, thereby enabling the dispensation of content. The button tray 2100 has moved from the aligned position in which content dispensed from the outlet 1200 is received in the button tray 2100 to a misaligned position in which content dispensed from the outlet 1200 is not received in the button tray 2100.

When the user subsequently releases the force pushing the button tray 2100, namely, when the user releases a container V, which is used to receive the content, from the button tray 2100, the button tray 2100 moves to an original position thereof (e.g., a position beneath the outlet 1200 or the aligned position).

In some examples, the button tray 2100 may be arranged in the interior of the door 60, even after the use thereof is completed. For example, the button tray 2100 may be configured such that, only when it is desired to use the button tray 2100, the button tray 2100 is ejected from the interior of the door 60, for the use thereof.

Where the button tray is configured such that, after the content dispensation, the button tray is again inserted into the interior of the door, a separate blocking device may be provided, in order to prevent the discharge of water or ice.

The operation of the tray drive mechanism in moving the button tray may use techniques similar to those described above.

FIG. 9 illustrates a front surface of a door including a dispenser, FIG. 10A illustrates a state in which a button tray composite device is in an extended position, and FIG. 10B illustrates a state in which a button tray composite device is in a withdrawn position. The food storing apparatus shown in FIGS. 9-10*b* includes a dispenser having outlets 1210 and 1230 to discharge certain contents, a door 60, at which the dispenser is installed, and a button tray composite device 3000 to control the dispensation of a desired content, and to receive a residual content discharged out of the outlet 1210 or 1230 after the content dispensation.

The button tray composite device 3000 includes a button switch 3800 to control the content dispensation, a button tray 3100 that defines a content receiving space (e.g., a recess) to receive the residual content, and a tray drive mechanism to move the button tray 3100.

The button tray composite device 3000 (including the button tray 3100, the movable member 3200, the roller 3300, and the spring wire 3400) is similar to the button tray composite devices (and components) described above. Accordingly, further description of the button tray composite device 3000 has not been provided.

The outlets 1210 and 1230, which discharge contents (e.g., ice and water, respectively), are positioned on or outside of the front surface of the door 60. The outlet 1210 is an ice outlet 1210 for discharging ice, whereas the outlet 1230 is a water outlet for discharging water.

In particular, the water outlet 1230 is positioned further from the front surface of the door 60, than the ice outlet 1210. In accordance with this arrangement, a convenience in use may be provided to a user that more frequently desires the dispensation of water, than the dispensation of ice.

The button tray 3100 is positioned at or outside of the front surface of the door 60 such that it is arranged beneath the outlets 1210 and 1230.

The food storing apparatus also may include a protective cover 1000 mounted to the front surface of the door 60, to protect the outlets 1210 and 1230. A control panel 1100 may be installed at the protective cover 1000, to control the dispensation of a content.

A lower tray 1250 also may be arranged beneath the button tray 3100, as an auxiliary tray to receive a residual content discharged out of the outlets 1210 and 1230 after the content dispensation. The lower tray 1250 may be mounted to a front frame of the door 60 by hooks 1251 such that the lower tray 1250 is removable and replaceable.

As shown in FIG. 10A, the button tray 3100 is positioned beneath the outlets 1210 and 1230 when no content is dispensed (e.g., the button tray 3100 is in an aligned position in which content dispensed from the outlets 1210 and 1230 is received in the button tray 3100).

When the user pushes the button tray 3100 toward the inner space of the door 60, the button tray 3100 is partially inserted into the inner space of the door 60. The button tray 3100 has moved from the aligned position in which content dispensed from the outlets 1210 and 1230 is received in the button tray 2100 to a misaligned position in which content dispensed from the outlets 1210 and 1230 is not received in the button tray 2100.

At this time, the button switch 3800 mounted to the rear wall of a moving member 3200 contacts or is connected to a dispensing switch 3700 installed in the inner space of the door 60, thereby enabling the dispensation of a certain content.

The content dispensing operation shown in FIGS. 10A and 10B may be similar to the content dispensing operation described above with respect to FIGS. 8A and 8B.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

As apparent from the above description, the button tray composite device functions as a switch for the content dispensation, but also functions to receive a residual content after the completion of the content dispensation. The button tray composite device may be used, irrespective of the position of an outlet, from which a content is discharged. For example, the button tray composite device may be used in the case in which an outlet is tilted out of an interior of a door, the case in which an outlet is protruded outwardly from a front surface of a door, and the case in which an outlet is arranged in a recess formed at a door.

The food storing apparatus described above may provide the following effects. First, the food storing apparatus may be able to prevent a residual content, additionally discharged after dispensing of a certain content, from being dropped onto the floor, in accordance with the provision of the button tray composite device, which not only functions as a button enabling content dispensing, but also functions as a tray receiving the residual content. In particular, the tray drive mechanism, which may be included in the button tray composite device, moves the button tray toward the outlet, from which the residual content is discharged, after the dispensing of content, in order to allow the button tray to easily receive the residual content.

The button tray composite device may be conveniently used in any case, irrespective of the position of an outlet, from which the content is discharged. For example, the button tray composite device may be used in the case in which the outlet is tilted out of the interior of the door, the case in which the outlet is provided-on a front surface of the door, and the case in which the outlet is arranged in a recess or dispensing cavity formed at the door.

The button tray composite device may receive the residual content, not only in a state in which the moving chute is positioned outside of a front surface of the door, but also in a state in which the moving chute is positioned into the interior of the door.

The thickness of the door may be reduced, in particular, in a region where the dispenser is installed, by configuring the dispenser such that the outlet of the moving chute, which dispenses ice or water, or the outlet of the water discharge duct is moved outside of the front surface of the door of the food storing apparatus when the dispenser is used, and is inserted into the interior of the door when the dispenser is not used.

The dispenser also may prevent the dispensing cover from coming into contact with the button tray when the moving chute is inserted into the inner space of the door, by the using a tray holder functioning to move the button tray, simultaneously with the insertion movement of the moving chute.

Also, the dispenser may prevent the dispensing cover from being moved when a button on a control panel is pressed, in a state in which the moving chute is positioned outside of a front surface of the door, by the provision of the cover fixing unit operating to release a fixing state in response to at least a predetermined force.

What is claimed is:

1. An appliance comprising:

a compartment;

a door configured to open and close at least a portion of the compartment;

a dispenser that is positioned on a surface of the door and that is configured to dispense content through a dispenser outlet; and a button tray composite device that includes:

a moveable receiving tray portion that is configured to move, at least partially toward and away from the door surface, in response to application of force against the moveable receiving tray portion;

a dispenser control mechanism configured to respond to repositioning of the moveable receiving tray portion by affecting an amount of content dispensed through the dispenser outlet; and a tray movement control mechanism configured to move the moveable receiving tray portion away from the door surface in the absence of external force applied to the moveable receiving tray portion in a direction that is toward the door surface, and to change a position of the moveable receiving tray portion from a first position that is misaligned with the dispenser outlet in response to external force that is applied to the moveable receiving tray portion to a receiving position that is aligned with and captures content dispensed through the dispenser outlet in response to removal of external force that is applied to promote positioning of the moveable receiving tray portion in the first position.

2. The appliance according to claim 1, wherein affecting an amount of content dispensed through the dispenser outlet comprises controlling whether or not content is dispensed through the dispenser outlet.

3. The appliance according to claim 1, wherein affecting an amount of content dispensed through the dispenser outlet comprises regulating dispensing of content through the dispenser outlet from among at least three settings, the three settings including a first setting in which content is not dispensed through the dispenser outlet, a second setting in which content is dispensed through the dispenser outlet at a first rate, and a third setting in which content is dispensed through the dispenser outlet at a second rate that is different than the first rate.

4. The appliance according to claim 1 wherein the tray movement control mechanism is configured to move the moveable receiving tray portion away from the door surface by rotating the moveable receiving tray portion away from the door surface about a pivot point.

5. The appliance according to claim 1 wherein the tray movement control mechanism is configured to move the moveable receiving tray portion away from the door surface by extending the moveable receiving tray portion away from the door surface in a plane perpendicular to the door surface.

6. The appliance of claim 1, wherein:

the moveable receiving tray portion has structure defining a content receiving space configured to receive and store content, the dispenser control mechanism includes a button switch configured to facilitate control over the dispenser to dispense content through the dispenser outlet; and the tray movement control mechanism includes a tray drive mechanism configured to move, in response to release of external force applied to the moveable receiving tray portion, the moveable receiving tray portion to the receiving position.

7. The appliance of claim 6, further comprising:

a dispensing switch that is positioned to contact the button switch in response to movement of the moveable receiving tray portion, and that is configured to control the dispenser to dispense content through the outlet in response to being contacted by the button switch.

8. The appliance of claim 6, wherein the tray drive mechanism comprises an elastic member having an elastic resilience against the external force applied to the moveable receiving tray portion.

9. The appliance of claim 6, wherein the button tray composite device further comprises:

a guide member configured to guide the movement of the moveable receiving tray portion along a guided direction.

10. The appliance of claim 9, wherein the button tray composite device further comprises:

a moving member that is selectively coupled to the moveable receiving tray portion, which is configured to move together with the moveable receiving tray portion in the guided direction when the moveable receiving tray portion is coupled to the moving member, and which is otherwise configured to remain stationary relative to the moveable receiving tray portion in the guided direction, and a coupler configured to couple the moveable receiving tray portion to the moving member.

11. The appliance of claim 10, wherein the coupler comprises:

a first coupling member mounted to one of the moveable receiving tray portion and the moving member, the first coupling member having magnetic properties; and a second coupling member that has metallic or magnetic properties and that is mounted to the other of the moveable receiving tray portion and the moving member such that the second coupling member is configured to be coupled to the first coupling member by a magnetic force.

12. The appliance of claim 6, wherein the tray drive mechanism comprises:

a roller configured to rotate; and a wire spring wound around a portion of the roller and configured to unwind from the roller in response to the external force applied to the moveable receiving tray portion, and to again wind around the roller and thus promote movement of the moveable receiving tray portion to the receiving position in response to release of the external force applied to the moveable receiving tray portion.

13. The appliance of claim 12, wherein a first end of the wire spring is coupled to a moving member that is configured to move together with the moveable receiving tray portion, and a second end of the wire spring is coupled to the roller.

14. The appliance of claim 1, wherein the dispenser comprises:

a moving chute that is configured to move between an operable position in which the moving chute is at least partially positioned on a side of the door surface opposite of the compartment, and a stored position in which the moving chute is positioned entirely on a side the door surface where the compartment is positioned, where the moving chute has structure that defines at least a portion of a passage through which content is discharged from the appliance.

15. The appliance of claim 14, wherein the moveable receiving tray portion has structure defining a content receiving space configured to receive and store content, and the moveable receiving tray portion is configured to move to a position in which at least a portion of the moveable receiving tray portion is positioned on the side of the door surface opposite of the compartment when the moving chute moves from the stored position to the operable position.

16. The appliance of claim 15, further comprising:

a tray holder configured to move the moveable receiving tray portion of the button tray composite device into a space defined within a frame of the door when the moving chute moves from the operable position to the stored position.

17. The appliance of claim 16, wherein the tray holder is coupled to one side of a moving member that is configured to move together with the moveable receiving tray portion.

18. The appliance of claim 14, wherein the dispenser comprises:

a dispensing cover arranged further from the compartment than the moving chute and configured to move with the moving chute; and a cover fixing unit that is configured to, when the moving chute is positioned in the operable position, prevent the dispensing cover from being moved by a force lower than a predetermined force, and that is configured to, when the moving chute is positioned in the operable position, allow the moving chute to move from the operable position toward the stored position in response to a force higher than the predetermined force.

19. The appliance of claim 18, wherein the cover fixing unit comprises:

an extension member configured to move with the moving chute;

a first coupling member mounted to one side of the extension member; and a second coupling member installed in the inner space of the door such that the second coupling member is coupled to the first coupling member to prevent the dispensing cover from being moved by a force lower than the predetermined force and is uncoupled from the first coupling member in response to a force higher than the predetermined force.

20. The appliance of claim 19, wherein the first and second coupling members are coupled by a magnetic force.

21. The appliance of claim 1, wherein:

the door has at least a portion extending into a dispensing cavity that houses the dispenser positioned on the door surface; and the outlet of the dispenser is arranged in the dispensing cavity.

22. The appliance of claim 1, wherein the outlet of the dispenser is positioned outside of a surface of the door that is furthest from the compartment.

23. A method for controlling an appliance, comprising:

causing a dispenser to dispense content in response to a button tray being pushed at least a particular distance from an original position in which the button tray is aligned with an outlet of the dispenser and configured to receive content dispensed by the dispenser to a first position in which the button tray is misaligned with the outlet of the dispenser; and moving, in response to release of an external force that caused the button tray to be pushed at least the particular distance, the button tray from the first position toward the original position in which the button tray is aligned with the outlet of the dispenser and configured to receive content dispensed by the dispenser to enable the button tray to receive a residual content dispensed by the dispenser.

24. The method according to claim 23, further comprising:

coordinating movement, together with the button tray, of a moving chute that defines a content discharge passage and that is positioned above the button tray when the appliance is oriented in an ordinary operating position.

25. The method according to claim 24, further comprising:

after causing the dispenser to dispense content, receiving the moving chute and the button tray into an inner space defined in a door of the appliance.

26. An appliance, comprising:

a dispenser;

a button tray configured to cause the dispenser to dispense content in response to being pushed at least a particular distance from an original position in which the button tray is aligned with an outlet of the dispenser and configured to receive content dispensed by the dispenser to a first position in which the button tray is misaligned with the outlet of the dispenser; and a tray drive mechanism configured to move, in response to release of an external force that caused the button tray to be pushed at least the particular distance, the button tray from the first position toward the original position in which the button tray is aligned with the outlet of the dispenser and configured to receive content dispensed by the dispenser.

* * * * *